US005507565A

United States Patent [19]

LeBegue et al.

[11] Patent Number: 5,507,565

[45] Date of Patent: Apr. 16, 1996

[54] METHOD AND APPARATUS FOR SUPPRESSING DUST AND FRICTIONAL IGNITION ON A CONTINUOUS MINING MACHINE

[75] Inventors: Maurice K. LeBegue, Bluefield, W. Va.; Ronald W. Keen, Blacksburg, Va.

[73] Assignee: Eimco Coal Machinery, Inc., Bluefield, W. Va.

[21] Appl. No.: 358,846

[22] Filed: Dec. 19, 1994

[51] Int. Cl.[6] ..... E21C 35/23

[52] U.S. Cl. ..... 299/12; 299/81.2

[58] Field of Search ..... 299/12, 81.1, 81.2, 299/78

[56] References Cited

U.S. PATENT DOCUMENTS

| | | | |
|---|---|---|---|
| 3,374,033 | 3/1968 | Arentzen | 299/81.2 |
| 3,698,769 | 10/1972 | Amoroso | 299/73 |
| 3,767,265 | 10/1973 | French et al. | 299/81.2 |
| 3,876,253 | 4/1975 | Parker | 299/81.3 |
| 3,876,254 | 4/1975 | Parker | 299/81.2 |
| 4,389,075 | 6/1983 | Kogler | 299/81.3 |
| 4,565,410 | 1/1986 | Hotger | 299/81.2 |
| 4,647,112 | 3/1987 | Demoulin et al. | 299/81.2 |
| 4,660,891 | 4/1987 | Kramer-Wasserka | 299/81.2 |
| 4,660,892 | 4/1987 | Demoulin | 299/81.2 |
| 4,696,518 | 9/1987 | Zitz et al. | 299/75 |
| 4,836,613 | 6/1989 | Adam | 299/81.2 |
| 4,852,947 | 8/1989 | Jones | 299/81.2 |
| 5,054,858 | 10/1991 | Harrison | 299/81.2 |
| 5,058,690 | 10/1991 | Hartwig et al. | 175/339 |
| 5,098,166 | 3/1992 | Ebner et al. | 299/81.2 |
| 5,114,213 | 5/1992 | Kornecki et al. | 299/81.2 |

FOREIGN PATENT DOCUMENTS 1111319 4/1968 United Kingdom .

2205880 12/1988 United Kingdom .

OTHER PUBLICATIONS

"The Wet–Head Miner Comes Back", Paul C. Merritt, *Coal Age*, Nov. 1987.

"Evaluation of Rotating Water Seal For Frictional Ignition Spray System on a Wet–Head Continuous Miner", Final Report L–1613, Bituminous Coal Research National Laboratory (undated).

*Primary Examiner*—David J. Bagnell

*Attorney, Agent, or Firm*—Price & Adams

[57] ABSTRACT

A boom mounted cutter drum assembly of a continuous mining machine includes an intermediate drum section and a pair of end drum sections. Spray nozzles on the cutting elements of the cutter drum assembly direct liquid spray at the mine face as mine material is dislodged to suppress dust and frictional ignition. Liquid for the spray nozzles is supplied on the mining machine through a stationary housing positioned between the intermediate drum section and the end drum sections. Water is conveyed through ports in the housing to a rotary seal assembly having stationary and rotating components. The ports are sealed by O-rings which communicate with passageways that divert liquid leakage at the rotary seal assembly away from the gearcase. The rotary seal assembly is surrounded by lip seals in the gearcase to separate the liquid passageways to the spray nozzles from the lubricant supplied to the gearcase. The lip seals communicate with the passageways vented to atmosphere so that any liquid leakage is diverted away from the gearcase. The lip seals exposed to the flow of liquid through the rotary seal assembly are also lubricated to maintain the seals operational during periods when liquid is not supplied to the spray nozzles. The lip seals and O-rings surrounding the rotary seal assembly also act as redundant liquid seals to prevent liquid from contaminating the gearcase.

20 Claims, 12 Drawing Sheets

METHOD AND APPARATUS FOR SUPPRESSING DUST AND FRICTIONAL IGNITION ON A CONTINUOUS MINING MACHINE

BACKGROUND OF THE INVENTION

1. Field of the Invention

This invention relates to method and apparatus for suppressing dust and frictional ignition in the operation of a mining machine and, more particularly, to a continuous mining machine having a cutter drum equipped with rotary water seals that permit water to be conveyed from a source into the center of the drum sections and along the lengths thereof externally of the drum sections to outlets positioned on cutter bits from which water is sprayed onto the mine face as the mine material is being dislodged to suppress the generation of dust and the occurrence of frictional ignition.

2. Description of the Prior Art

In underground mining operations using either longwall shearers or drum-type continuous miners, it is well known to locate water spray nozzles on the cutting drum near each bit to suppress the generation of airborne dust and frictional ignition as the cutter bits engage the mine face. It is also known to suppress airborne dust and wet dislodged material by mounting spray nozzles on a bar located behind the cutter drum. The bar mounted spray nozzles wet the mine material above and below the cutter drum and also wet the bits as the cutter drum completes each rotation.

The effectiveness of a spray bar is limited and does not effectively control dust before it becomes airborne. However, the incorporation of spray nozzles with the cutter bits on the surface of the cutter drum has been found to be effective in suppressing dust before it becomes airborne. The water is continuously sprayed from the bits at the point where the material is dislodged from the mine face. Generating a water spray at the bits suppresses the dust at its source and effectively eliminates any risk of frictional ignition as the cutter bits strike the solid material. Generating a water spray from the nozzles also serves to extend the life of cutter bits on for both longwall miners and continuous miners.

It is the conventional practice to supply water to the nozzles on the surface of a shearer drum and a continuous miner drum from a water supply on the miner. For example, water is supplied from the cooling circuits of the drive motors and conveyed through conduits in stationary struts and housings to a rotary seal mounted concentrically on the axis of the drum. The rotary seal has a stationary part with ports for receiving the water and a rotational part mounted on the drive shaft. The water is directed inwardly through the rotary seal to a channel extending on the axis of the drive shaft. The water is conveyed through the drive shaft to a manifold connected by fittings to the spray nozzles associated with the cutter bits. The spray is directed from behind the cutter bits onto the area where the bit strikes the mine face.

A critical aspect in supplying water through a cutter drum to the external surface behind the cutter bits is the effectiveness of the rotary seal to prevent leakage of water into the gearcase and bearings. This problem is more readily solved with a longwall drum shearer because the drive shaft is more accessible for water supply and a smaller diameter rotating seal can be used compared to what is required for a continuous miner. A relatively large rotating seal must be used around the drive shaft of a continuous miner. This problem is further complicated with continuous miners having multiple sections. A typical continuous miner includes a pair of end drum sections and an intermediate drum section. Each section has a separate drive shaft as opposed to a single drive shaft with a longwall drum shearer.

In addition to preventing contamination of the gearcase and bearings, the rotary seal must withstand periods of time in which it runs dry where water is not circulated to the seal. The seal must also be protected from damage due to the accumulation of dirt in the water passageways and plugging of the sprays by pipe scale. In addition, the rotary seal must accommodate water leakage at the point where water passes from the stationary component of the seal to the rotating component of the seal.

Preferably, the rotary seal is installed on the drum section as a sealed unit to permit the conversion of a conventional continuous miner to one that supplies water to nozzles associated with each cutter bit on the cutter drum. The seal must be mounted so that it can be accessed without disabling operation of the mining machine for an extended period of time. The seal must be readily accessible for repair and replacement when required.

A number of systems have been proposed for sealing the rotating and stationary components through which water flows in generating a spray behind the cutter bits of a continuous mining machine. For example, U.S. Pat. No. 3,698,769 discloses a mining machine having a boom supported cutter drum in which a liquid inlet extends through each boom arm from a pressurized source of water. A tube is connected to a nonrotatable connector which encircles a shaft that rotatably supports the cutter drums of the mining machine. The liquid supplied to the inlet flows through the tube and through an arrangement of bores in a stationary housing that surrounds the rotatable shaft. A housing is clamped to the drive shaft for rotation therewith and includes a number of chambers which are positioned oppositely of the bores that convey the water through the stationary housing. The water flows from the stationary housing into the rotatable housing where the water is conveyed to a bore that extends axially through the drive shaft. From the axial bore the water is conveyed to outlets that discharge the liquid from the periphery of the cutter drum. The fluid connection between the stationary housing and the rotatable housing is sealed by sealing rings which prevent leakage to the bearings and gears but allows leakage past the rings externally of the mining head so that it may be readily and quickly detected.

In U.S. Pat. No. 3,876,254 a mining machine is disclosed in which liquid is supplied for dust suppression on the cutter drum. The liquid is supplied from a source to a channel in the wall of a stationary gearcase. The channel extends through the gearcase to a fluid transfer apparatus at an interface between stationary and rotating members. The transfer apparatus includes rotary seals in which water enters a space between a stationary portion of the seal and a rotating portion of the seal. The water pressure maintains the sealing members in sealing relation with the surrounding housings and a loss of liquid pressure reduces the pressure against the sealing members. From the rotary seal the water is conveyed through channels to the surface of the cutter drum from which the water is emitted from spray nozzles positioned on the periphery of the cutter drum.

With the mining machine disclosed in U.S. Pat. No. 3,374,033 water is circulated into the cutter drum and is discharged from nozzles into the kerf where cutting of material from the mine face takes place. The cutter drum is rotated by a shaft within a nonrotatable sleeve. A sealing ring is positioned between the rotatable shaft and the nonrotatable sleeve. The sealing ring includes openings that register with ports for water to pass through passages from the sleeve to a cutter wheel where the passages terminate at nozzles located in advance of the bit holders on the surface of the cutter drum. A sealing ring is positioned between the rotatable shaft and nonrotatable sleeve and bears against a valve ring which includes an arcuate passageway that supplies water to the nozzles from the passages and the nonrotatable sleeve in a predetermined arc of travel of the cutter wheel. In this manner, water is discharged from the nozzles onto the cutting face in a preselected arc so that the water is discharged just when the cutting is taking place and where dust is being generated.

U.S. Pat. No. 4,565,410 discloses a nozzle positioned near the periphery of cutting elements on a longwall mining machine for discharging liquid onto the coal face during the cutting operation. Valves control the flow of liquid to the nozzles so that liquid is discharged therefrom when the nozzles are opposite the coal face immediately ahead of the shear drum during the cutting operation. The valves prevent the supply of high-pressure liquid to those nozzles of the drum which are not directed to the mine face.

U.S. Pat. No. 3,767,265 also discloses dust suppression equipment on a longwall mining machine in which a fixed tube extends along the axis of a hollow drive shaft for feeding dust suppression fluid from the body of the machine toward the shearer drum. Water is supplied through the tube to a distributor located within the drum and arranged to feed the water to a plurality of pipes located angularly around the drum. A phasing disc is mounted on the end of the tube to rotate only with the tube so that the water is conveyed to only selected passages associated momentarily with the cutting zone of the shearer drum.

U.S. Pat. Nos. 3,876,253; 4,660,892; and 4,852,947 further disclose mining machines with rotating cutter drums having sealed piping systems that deliver water through stationary housings to rotatable housings and through drive shafts to the surface of the cutting drums. U.S. Pat. Nos. 4,647,112 and 4,836,613 disclose mining machines having cutting elements provided with high pressure nozzles for generating a stream of water at pressures capable of dislodging material from the mine face.

With the above described devices conventional seal rings are used to provide a rotary seal between the stationary and rotating components of the cutter drum. Also as pointed out above, the problem of maintaining an effective seal at the rotary interface is more acute in a continuous miner because of the large diameter required for the rotary seal in comparison with a smaller diameter rotary seal encountered with a longwall shearer drum. The large diameter rotary seal used in a continuous miner must operate for an extended period of time in a dust filled atmosphere to prevent leakage of the spray fluid to the bearings and gears within the gearcase. The seals must be supported within the cutter drum in a manner that permits efficient access for repair and maintenance without extended downtime of the mining machine.

More recently rotary water seals for mining machines have been proposed for preventing leakage of water into the gearcase and operating dry for extended periods of time when water spraying is not utilized. When water seals run dry they harden and loose their sealing capabilities. The seals must then be replaced which is a difficult task when the machine is operating at the mine face. Frequently the mining machine must be moved to a maintenance area or taken out of the mine to replace worn water seals.

A cartridge seal manufactured and sold by Cannings Seals Ltd., a British company, has been publicly tested by the U.S. Bureau of Mines for use with water spray systems mounted on mining machines. The cartridge seal consists of a double-faced sealing arrangement contained as a cartridge unit with a stainless steel housing. The seal assembly is comprised of two seal rings having opposed faces in which the rotating face is fabricated of resin carbon and the stationary face is fabricated of tungsten carbide arranged concentrically. To prevent leakage during operation, each of the face rings is lapped to a flatness within one wavelength of helium light band. In addition, multiple springs provide initial face loading before the addition of hydraulic forces and dowels maintain positive drive to all components.

The cartridge configuration of the Cannings seal ensures that the rotating and stationary components remain in correct axial and radial relationships during transit and fitting. A dirt-exclusion labyrinth seal keeps the seal clean in operation as a cartridge assembly. The seal, as a cartridge assembly, is a self-contained unit easily mounted, maintained and removed from the machine.

In operation of the cartridge seal, water is introduced to an axial port through the outer diameter of the unit and is channeled between the two seal face pairings to a further port in the component that rotates with the drive shaft. Secondary low pressure lip seals prevent incidental leakage of water crossing the seal faces, directing leakage to atmosphere. The cartridge seal is positioned within the cutter drum housing outside the gear housing to ensure that any seal leakage does not contaminate the internal bearings and gears. This cartridge seal is also reported as being capable of running dry for extended periods of time without damage.

While cartridge seals have proved to be effective in controlling the flow of water to the cutter drum of a continuous mining machine for suppression of dust and frictional ignition, further improvement is needed in a rotary seal for preventing liquid leakage into the gearcase housing and directing leakage to the atmosphere. The rotary seal must be capable of installation and removal at the work sight with a minimum amount of interruption in the operation of the mining machine. The seal must be readily accessible to lubricate the seal components within the cutter drum assembly to preserve the life of the rotary seal, particularly when the seal is run dry. The rotary seal must be positioned in the cutter drum housing to provide efficient access for hose connections and permit its replacement without loss of gear housing lubricant.

Other examples of rotary seal arrangements used in controlling the flow of water to the periphery of a cutting drum of a mining machine are disclosed in U.S. Pat. Nos. 4,660,892; 4,696,518; 5,054,858; 5,098,166; and 5,114,213 and published British Patent Specification Nos. 1,111,319 and 2,205,880.

While it is known to provide a rotary seal between the stationary and rotating components of a cutter drum assembly of a mining machine to supply a dust and ignition suppressing fluid to nozzles on the cutter bits, the known devices do not satisfactorily prevent leakage into the gearcase and at the same time provide lubrication of the rotary seal. Therefore, there is need for a rotary seal that effectively controls fluid leakage and is lubricated to resist wear in a fluid system for a cutter drum assembly.

SUMMARY OF THE INVENTION

In accordance with the present invention there is provided a mining machine that includes a body portion and a boom member extending forwardly from the body potion. A cutter drum assembly is rotatably mounted on the boom member. Cutting elements are secured to the cutter drum assembly and extend therefrom. Bearing means rotatably support the cutter drum assembly on the boom member. Power means is mounted on the body portion for rotating the cutter drum assembly. Drive means transmits rotation from the power means to the cutter drum assembly. Spray devices carried by the cutting elements direct a liquid spray from the cutting elements during rotation of the cutter drum assembly. Conduit means are stationarily positioned on the body portion for supplying liquid to the cutter drum assembly. Liquid passageways extending through the cutter drum assembly and rotating therewith direct liquid from the conduit means to the spray devices. A liquid seal assembly is carried by the cutter drum assembly for directing liquid from the stationarily positioned conduit means to the rotatable liquid passageways while preventing leakage of liquid into contact with the bearing means. Drainage means extending from the seal assembly through the cutter drum assembly divert liquid leakage away from the bearing means and externally out of the cutter drum assembly. Lubricant passageways extending through the cutter drum assembly supply lubricant to the liquid seal assembly. A lubricant seal assembly is positioned in the cutter drum assembly in surrounding relation with the liquid seal assembly and in contact with the lubricant passageways for preventing the escape of liquid into the bearing assembly and permitting lubricant to be supplied for lubricating the liquid seal assembly. The lubricant seal assembly is positioned between the bearing assembly and the liquid seal assembly and communicates with the drainage means so that liquid leakage from the liquid seal assembly toward the bearing assembly is stopped by the lubricant seal assembly and diverted to the drainage means.

Further in accordance with the present invention there is provided a method for spraying a mine face with liquid during a mining operation that includes the steps of rotatably supporting a cutter drum assembly on a boom member extending forwardly of a machine body portion. Cutting elements are secured to the surface of a cutter drum assembly. The cutter drum assembly is rotated to dislodge material from the mine face by the cutting elements. A liquid spray is discharged from the cutting elements as the cutter drum assembly rotates. Liquid is supplied to the cutter drum assembly from the machine body portion. Flow of liquid is directed through liquid passageways from a stationary portion to a rotatable portion of the cutter drum assembly and therefrom to the cutting elements on the cutter drum assembly. Seals of a liquid seal assembly are positioned between the stationary portion and the rotatable portion to prevent liquid from coming into contact with bearings for rotatably supporting the cutter drum assembly. A lubricant seal assembly is positioned in surrounding relation with the liquid seal assembly between the liquid seal assembly and the bearings. Lubricant is supplied for the lubricant seal assembly and the liquid seal assembly. Liquid leakage is diverted from the liquid seal assembly away from the bearings and vented through cavities to atmosphere. The liquid seal assembly is backed up by the lubricant seal assembly to prevent liquid leakage to the bearings and divert liquid leakage through the cavities and externally of the cutter drum assembly.

A further feature of the present invention includes a seal assembly for a cutter drum of a mining machine that includes a plurality of cutting elements secured to the periphery of the cutter drum. A gearcase is positioned in the cutter drum. Bearing means rotatably support the gearcase in the cutter drum. Means is provided for supplying lubricant to the gearcase for lubricating the bearing means. Lubricant seal means is positioned in the gearcase for maintaining lubricant in contact with the bearing means and preventing contaminants from coming in contact therewith. A plurality of spray devices are associated with the cutting elements for generating liquid spray therefrom. Means is provided for supplying liquid flow through the gearcase to the spray devices. Liquid seal means is positioned in the gearcase for directing liquid through the gearcase to the spray devices and preventing liquid from coming into contact with the bearing means. The liquid seal means is vented to atmosphere so that liquid leakage from the liquid seal means is directed away from the bearing means externally of the gearcase. The lubricant seal means surrounds the liquid seal means in the gearcase to act as a redundant seal to prevent liquid leakage from the liquid seal means contaminating the bearing means. The liquid seal means and the lubricant seal means communicate with a common source of lubricant thereto and are connected through passageways for venting liquid leakage to be vented to atmosphere externally of the gearcase.

Accordingly, a principal object of the present invention is to provide method and apparatus for supplying liquid to a cutter drum assembly of a mining machine for directing a liquid spray from cutting elements on the periphery of the cutter drum assembly to suppress dust and frictionally ignition as material is dislodged from a mine face during the mining operation.

Another object of the present invention is to provide apparatus for supplying liquid through the stationary and rotatable components of a mining machine cutter drum to generate a water spray from the surface of the cutter drum as the drum rotates and direct any leakage of liquid from the seals in the gearcase externally of the drum.

A further object of the present invention is to provide method and apparatus for sealing the stationary and rotatable portions of a cutter drum assembly to permit water to pass through the cutter drum assembly to spray devices on the periphery thereof and prevent water from coming in contact with the bearings in the gearcase.

An additional object of the present invention is to provide lubricant and liquid seals within a gearcase of a mining machine cutter drum assembly so that water leakage from the liquid seal is diverted externally of the drum and backed up by the lubricant seals and prevented from entering the bearing assembly and where the liquid seal receives lubricant from the lubricant seal to maintain its operational life.

Another object of the present invention is to provide a liquid seal surrounded by a lubricant seal in a mining machine cutter drum assembly where liquid passes through the cutter drum and is prevented from entering the gearcase and the liquid seal is lubricated where excess lubricant and water leakage pass through the same cavities open to atmosphere.

These and other objects of the present invention will be more completely disclosed and described in the following specification, the accompanying drawings, and the appended claims.

DESCRIPTION OF THE PREFERRED EMBODIMENTS

Figure 1:
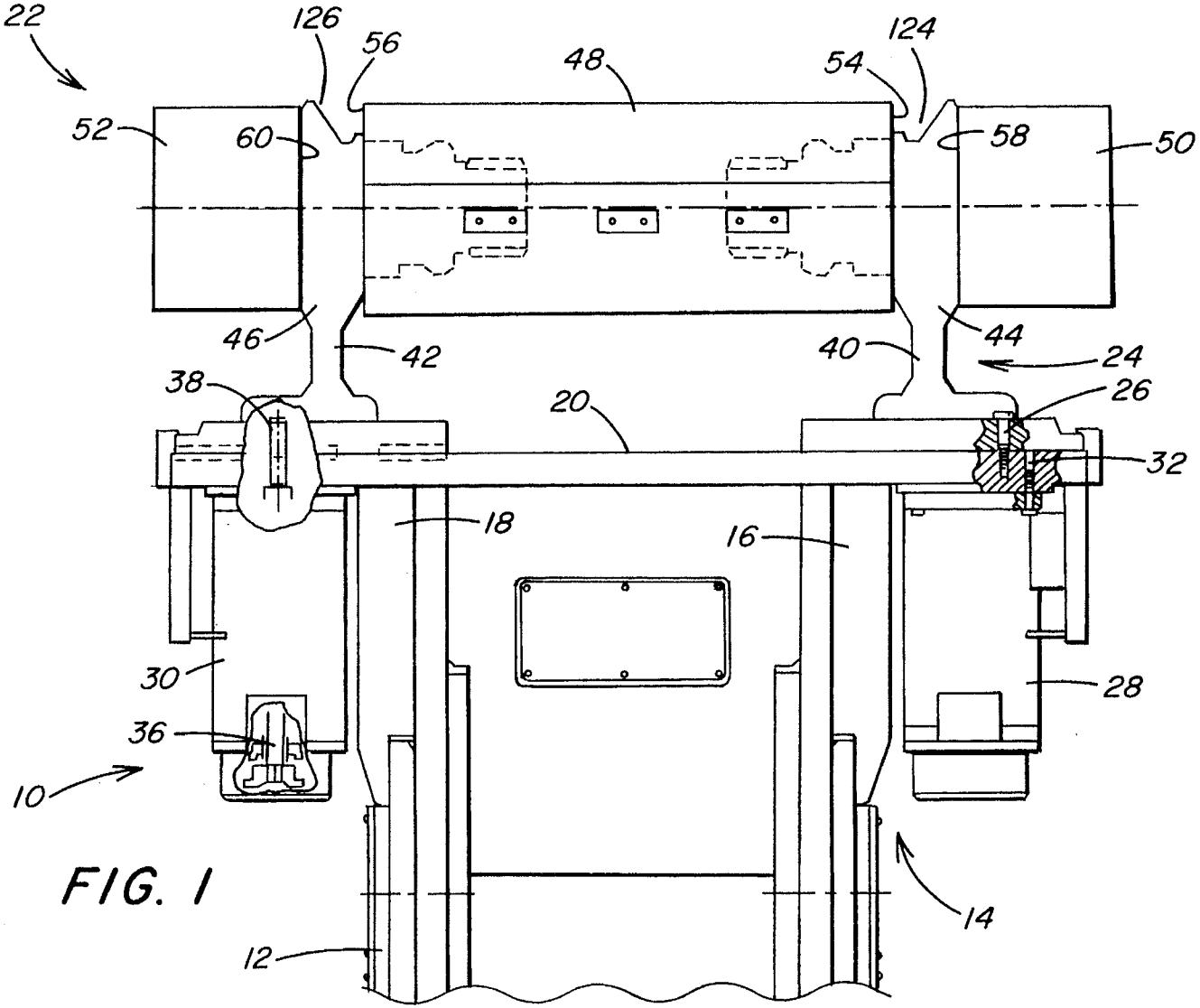
FIG. 1 is a fragmentary schematic plan view of a continuous mining machine, illustrating a cutter drum assembly rotatably supported by a boom on the front end portion of the mining machine.

Referring to the drawings and particularly to FIG. 1, there is illustrated a continuous mining machine generally designated by the numeral 10 that has a body portion 12 suitably mounted on traction devices (not shown), such as endless crawler tracks for advancing the mining machine in a mine. As well know in the art and beyond the scope of the present invention, an endless conveyor mechanism extends longitudinally on the body portion 12 to convey dislodged material from the front of the mining machine to a discharge end portion of the conveyor. Further, a suitable gathering device (not shown) extends forwardly from the body portion 12 and gathers the dislodged material and feeds the material onto the conveyor so that the material is conveyed rearwardly on the mining machine.

A forwardly extending boom member generally designated by the numeral 14 includes a pair of parallel arm members 16 and 18 that extend forwardly from the machine body portion 12 and are connected to each other by a transverse housing 20. The arm members 16 and 18 are pivotally connected to the mining machine body portion 12 and to piston cylinder assemblies (not shown). Upon actuation of the assemblies, the arm members 16 and 18 pivot about their connections to the body portion 12 to move the boom member 14 vertically. In this manner, a cutter drum assembly 22 executes an upward or downward shear cut of a mine face. The cutter drum assembly 22 is rotatably supported on the end of the boom member 14.

CUTTER DRUM ASSEMBLY

The cutter drum assembly 22 is supported by a drum housing generally designated by the numeral 24 connected by bolts 26 to the boom member transverse housing 20. A pair of cutter drum motors 28 and 30 are mounted by bolts 32 to the boom member transverse housing 20. Each motor 28 and 30 includes a clutch housing secured to the rear of the motor and having a clutch assembly 36 drivingly connected to a motor shaft 38. Each motor shaft 38 transmits rotation from the respective motors 28 and 30 through the nonrotatable drum housing 24 to the cutter drum assembly 22.

The drum housing 24 includes a pair of arm members 40 and 42 which extend from the transverse housing 20 of the boom member 14. A pair of nonrotatable annual housing portions 44 and 46 extend forwardly from the drum housing arm members 40 and 42. The rotatable portions of the cutter drum assembly 22 are mounted on the nonrotatable annular housing portions 44 and 46. The drive shafts for the cutter drum assembly 22 extend through the annular housing portions 44 and 46 and are connected to the drive gearing for rotating the cutter drum assembly 22 to dislodge material from the mine face.

As shown in FIG. 1, the cutter drum assembly 22 includes an intermediate drum section 48 and a pair of end drum sections 50 and 52. The intermediate drum section 48 is rotatably supported by the annual housing portions 44 and 46. The intermediate drum section 48 has outer annular edge portions 54 and 56 spaced from inner annular edge portions 58 and 60 of the end drum sections 50 and 52 respectively. The annular housing portions 44 and 46 extend between the openings between the intermediate drum section 48 and the end drum sections 50 and 52. The drum sections 48, 50 and 52 are, therefore, rotatably supported relative to the fixed annular housing portions 44 and 46.

The intermediate drum section 48 and the end drum section 50 and 52 include a plurality of cutting elements that extend peripherally from the respective drum sections. The cutting elements are positioned on the surface of the respective drum sections in a preselected bit pattern formed by rows of cutting elements mounted on the peripheral surfaces of the drum sections.

Figure 13:
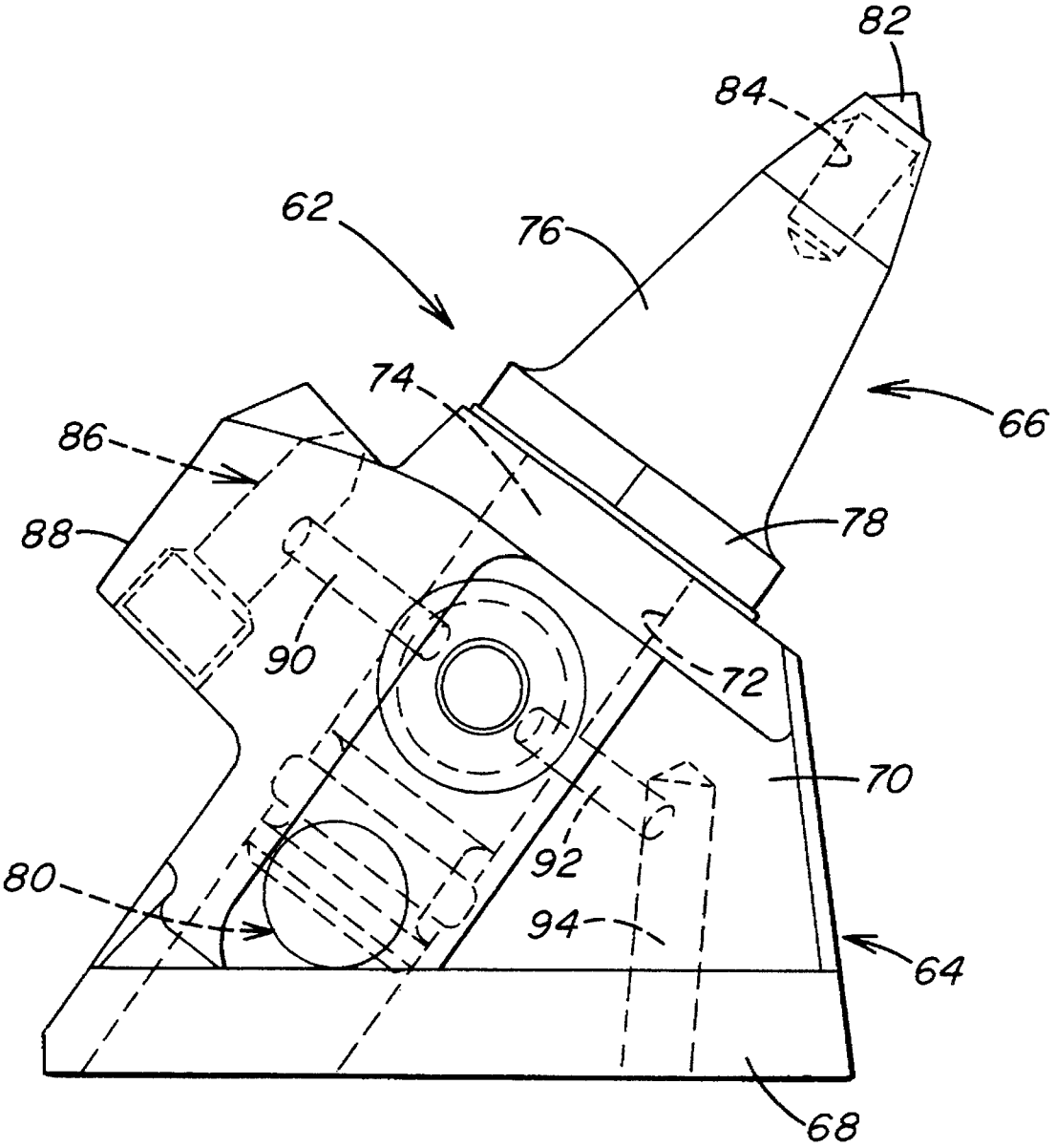
FIG. 13 is a view in side elevation of a cutter bit assembly representative of the cutter bit assemblies mounted on the mining machine shown in FIG. 1, illustrating a spray nozzle mounted on the assembly.

For the purposes of clarity of illustration, the individual cutting elements are not shown on the cutter drum assembly 22 illustrated in FIG. 1. However, a representative cutting element generally designated by the numeral 62 is illustrated in FIG. 13. The cutting element 62 is representative of all of the cutting elements mounted on the intermediate drum section 48 and end drum sections 50 and 52.

The cutting elements 62 are positioned on the respective drum sections in a preselected pattern to dislodge a continuous kerf from the mine face without leaving unmined portions in the face. As the cutter drum assembly 22 rotates it executes a shear cut in the mine face, and a relatively horizontal roof and floor are formed in the mine passageway.

CUTTING ELEMENT WITH SPRAY NOZZLE

The representative cutting element 62 shown in FIG. 13 includes a bit holder generally designated by the numeral 64 and a replaceable cutter bit generally designated by the numeral 66. The bit holder 64 includes a base portion 68 that is suitably connected, as by welding, to the surface of the respective cutter drum section. A pedestal 70 extends upwardly from the base portion 68 and includes a centrally positioned bore 72 for receiving a shank 74 of the cutter bit 66. A head 76 of the cutter bit 66 extends from and is formed integral with the shank 74.

As shown in FIG. 13 the head 76 includes a shoulder 78 at its lower end portion thereof that seats on the outer surface of the base portion 68 around the bore 72 when the shank 74 is positioned completely within the bore 72. The shank 74 includes a conventional retainer device generally designated by the numeral 80 for releasably retaining the shank 74 in the bore 72. The cutter head 76 includes a cutting tip 82 fabricated of a preselected hardened material that is retained within a bore 84 in the outer end of the bit head 76. In the event the cutting tip 82 becomes worn the cutter bit 66 can be easily removed and replaced.

In accordance with the present invention, the bit holder 64 retains a spray nozzle generally designated by the numeral 86 within a bore extending through a shoulder 88 of the pedestal 70. The spray nozzle 86 is positioned rearwardly of the cutting tip 82 in the bore which is connected by a series of connected passageways 90, 92, and 94 that extend through the shoulder 88, pedestal 70, and base portion 68. The passageways 90, 92, and 94 are connected to a supply of water or any other liquid suitable as a dust and ignition suppressant which is sprayed from the nozzle 86. The spray is directed from the nozzle 86 in a pattern toward and above the cutting tip 82 so as to contact the cutting tip 82 and the point at which the tip 82 engages the mine face to dislodge material as the cutter drum assembly 22 rotates.

The nozzle 86 positioned within the shoulder 88 includes a passageway connected to receive water from the passageway 90. The passageway 94 extending through the bit holder base portion 68 is connected as illustrated in greater detail in FIG. 4 to liquid passageways that extend through the housing of the cutter drum assembly 22 for receiving liquid, such as water. The water is conveyed in accordance with the present invention through the cutter drum assembly 22 to the cutter bit 66 in a manner explained later in greater detail.

CUTTER DRUM SECTIONS

Figure 2:
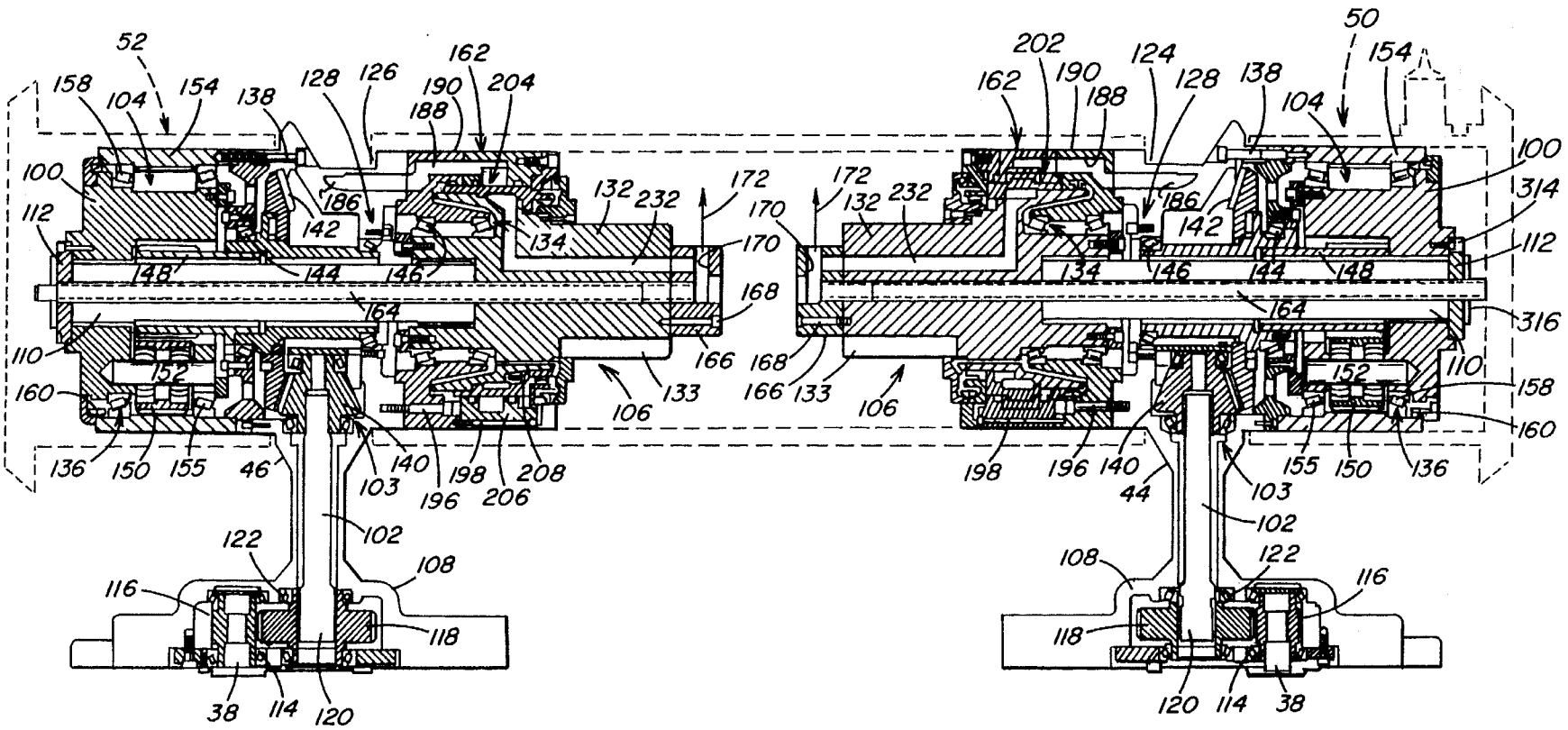
FIG. 2 is a schematic sectional view of a pair of end drum sections of the cutter drum assembly shown in FIG. 1, illustrating a rotary water seal arrangement for conveying water into and through both the end drum sections.

Now referring to FIGS. 2–5 in which like numerals throughout the figures identify like parts illustrated in FIGS. 2–5, there is illustrated in FIG. 2 the gearcases within end drum sections 50 and 52 with the intermediate or center drum section 48 omitted for purposes of clarity of illustration. Each of the end drum sections 50 and 52 shown in FIG. 2 is identical in that water is supplied to both end drum sections for distribution to the cutter bits 66 on the surface thereof.

Figure 3:
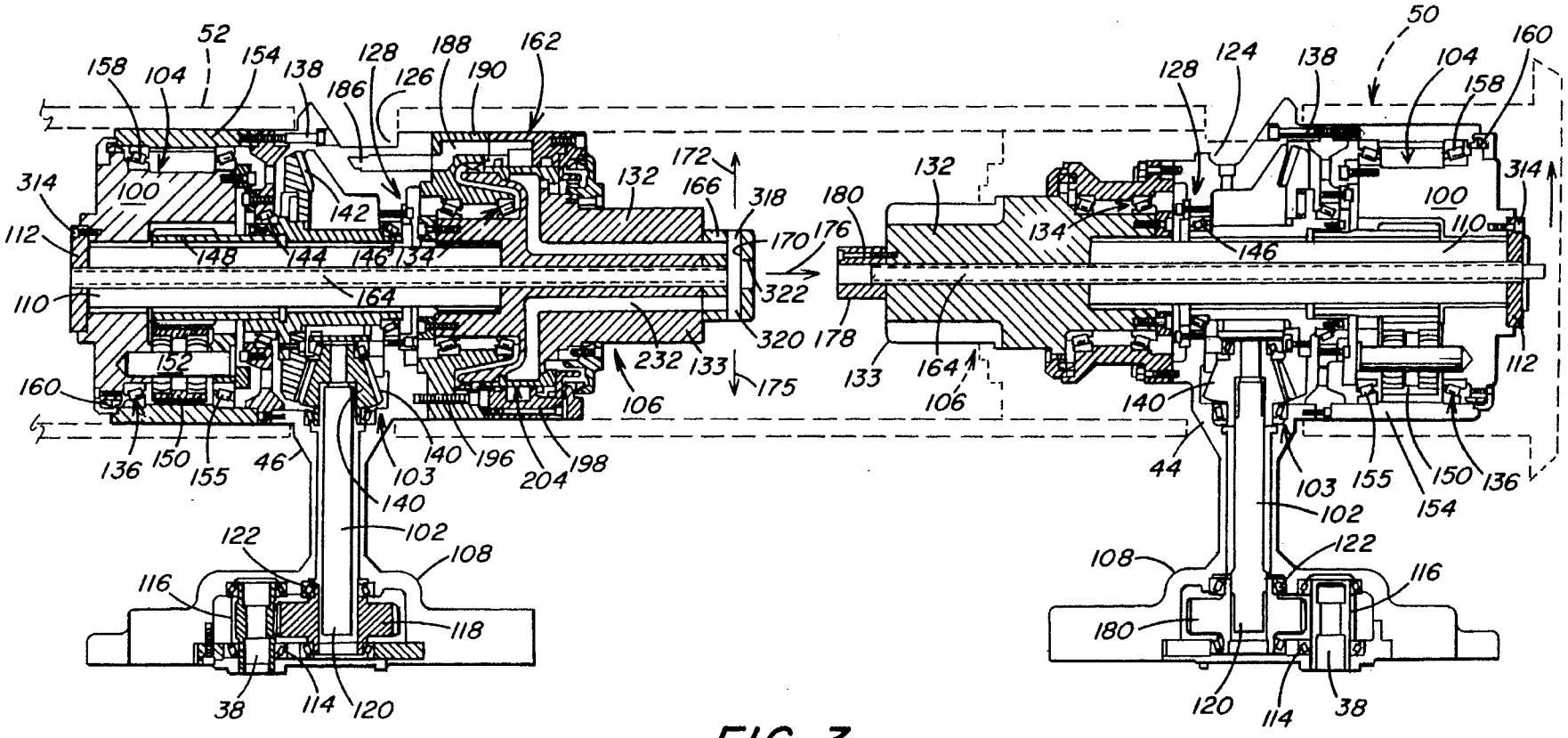
FIG. 3 is a schematic sectional view similar to FIG. 2, illustrating a rotary water seal arrangement positioned in only one end drum section for receiving and conveying water to the intermediate and opposite end drum sections.

An alternative embodiment is shown in FIG. 3, in which water is supplied only to the end drum section 52 through a rotary seal into the end drum section and along the axis thereof for distribution to the surface of the drum section 52. The opposite end drum section 50 does not receive a flow of water externally from the drum into the drum housing. For this reason the end drum section 50 does not include a rotary seal between the stationary and rotatable components thereof. Water flow from end drum section 52 is directed to the intermediate drum section 48 and therefrom to the end drum section 52. With this arrangement, only one rotary seal is required in one end drum section. The water flow is directed centrally through the remaining drum sections and outwardly to the cutting elements 62.

DRUM DRIVE ASSEMBLY

Figure 4:
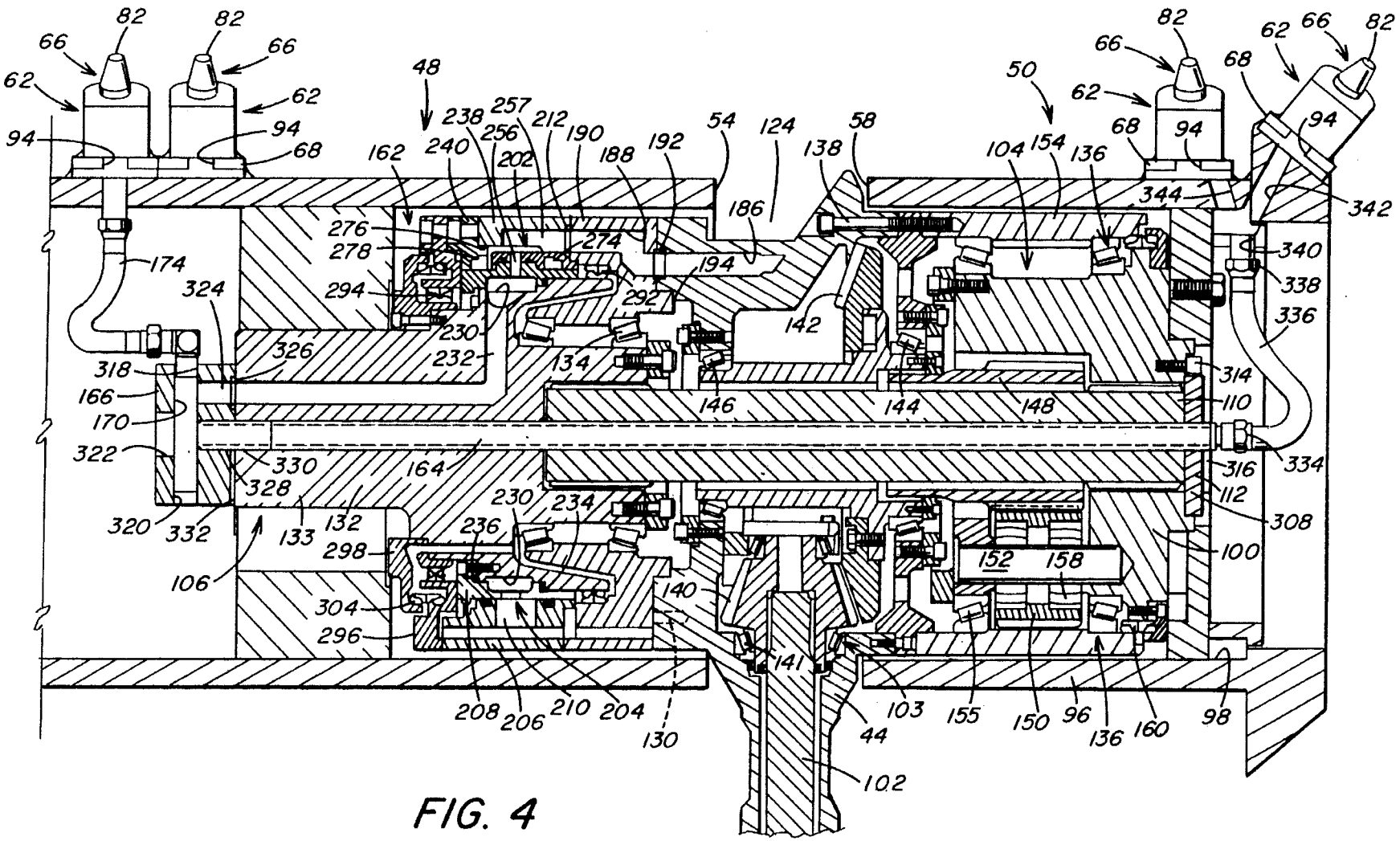
FIG. 4 is a fragmentary sectional view of an end drum section of the mining machine, illustrating two embodiments of a rotary water seal for conveying water into and through the end drum section.

With each of the end drum sections 50 and 52 illustrated in FIGS. 2 and 3 the internal drive mechanisms therefor are identical; therefore, like numerals refer to like parts in FIGS. 2–5 for both end drum sections 50 and 52. As illustrated in FIG. 4 each drum section 50 and 52 has a cup-shaped body portion 96 having inner annular edge portions 58 and 60 respectively and an opening 98. A drive shaft 100 is connected to the body portion 96 by suitable fastening devices to transmit rotation to the body portion 96 which carries the cutting element 62.

Rotation from the pair of drum rotating motors 34, as shown in FIG. 1, is transmitted to the drive gearing of the cutter drum assembly 22. Each motor 34 is drivingly connected through a disk clutch mechanism (not shown) to an input drive shaft 102 of a bevel pinion gear set generally designated by the numeral 103 in FIGS. 2 and 3. The bevel pinion gear set 103 transmits rotation to a planetary gear assembly generally designated by the numeral 104 in each end drum section 50 and 52. The planetary gear assembly 104 transmits rotation to the end drum drive shaft 100 to rotate the respective end drum sections 50 and 52. Rotation is also transmitted from the planetary gear assembly 104 to a driven shaft generally designated by the numeral 106 for rotating the intermediate drum section 48.

Figure 5:
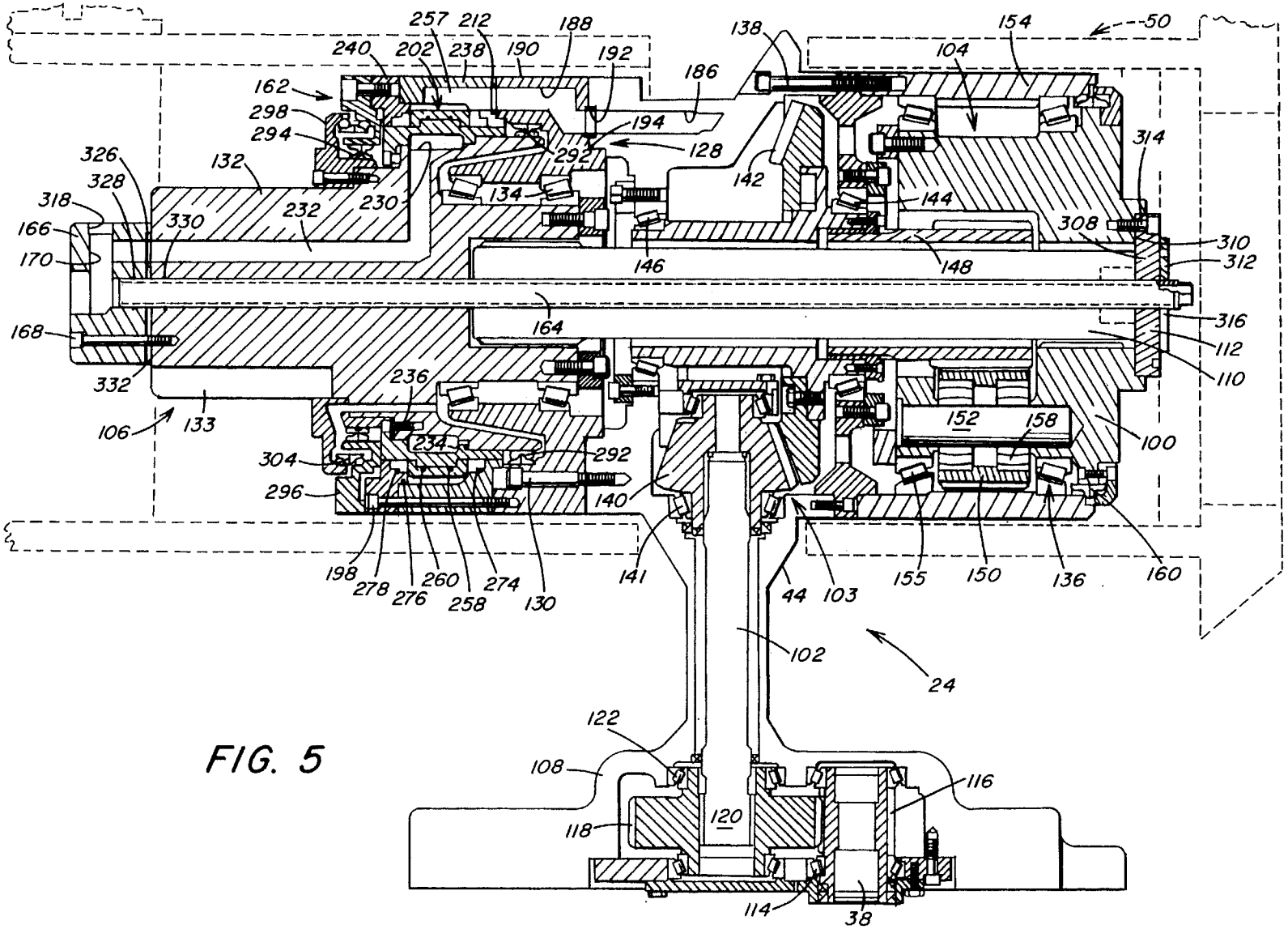
FIG. 5 is an enlarged sectional view of one of the end drum sections shown in FIG. 2, illustrating the passageways for liquid flow through the rotary seal and into the rotating shaft from which liquid is conveyed to spray nozzles on the surface of the cutter drum.

The drum housing 50 shown in detail in FIGS. 2 and 5 includes a gear housing 108 for receiving the drive connection from the motor 34. The gear housing 108 is formed integral with annular housing portion 44, 46. The end drum section 50 and the intermediate drum section 48 are rotatably mounted on the annular housing portion 46. The end drum section 52 and intermediate drum section 48 are rotatably mounted on the annular housing portion 46. The input drive shaft 102 of the bevel gear set 103 extends through the housing portion 44, 46 and is connected to the planetary gear assembly 104 within the end drum section 50, 52 for rotating the drive shaft 100 to rotate the drum section 50, 52 to dislodge material from the mine face.

The end drum drive shaft 100 is drivingly connected to an intermediate drum drive shaft 110. The opposite end of the intermediate drum drive shaft 110 is connected to the driven shaft 106 of the intermediate drum section 48. Thus, the driven shaft 106 transmits drive from the intermediate drive shaft 110 to the intermediate drum section 48.

The motor drive shaft 38 extends into the gear housing 108 where it is rotatably supported by bearings 114 and includes a splined end portion that meshes with gear 116. The gear 116 transmits rotation from shaft 38 to a meshing gear 118 nonrotatably connected to a splined end portion 120 of the input drive shaft 102. The input drive shaft 102 is rotatably supported within the gear housing 108 by bearings 122.

As illustrated in FIG. 1, the annular edge portions 54 and 56 of the intermediate drum section 48 and the edge portions 58 and 60 of the end drum section 50 and 52 are spaced apart to form a pair of openings 124 and 126 between the intermediate drum section 48 and the respective end drum sections 50 and 52. The drum housing 24 is positioned between the openings 124 and 126. The annular housing portions 44 and 46 extend around the openings 122 and 124 and rotatably support the intermediate drum section 48 and the end drum section 50 and 52.

The drum housing 24 shown in detail in FIG. 5 includes a bearing assembly generally designated by the numeral 128 connected by bolts 130 to the respective annular housing portions 44 and 46. The driven shaft 106 includes a shaft portion 132 which is rotatably supported within the bearing assembly 128 by bearings 134. The intermediate drum section 48 is nonrotatably connected to the end of the shaft portion 132. At the opposite end each end drum section 50 and 52 includes a bearing assembly 136 which is connected by bolts 138 to the respective annular housing portion 58, 60. With this arrangement, the intermediate drum section 48 and the end drum sections 50 and 52 are rotatably supported on the end of the boom member 14.

END DRUM PLANETARY GEAR ASSEMBLY

The bevel pinion gear set 103 shown in FIGS. 2–4 and in greater detail in FIG. 5 includes a pinion 140 splined to the outer end portion of the input drive shaft 102. The pinion 140 is supported by bearings 141 in annular housing portion 44 and meshes with a bevel gear 142. The bevel gear 142 is rotatably supported within the respective end drum section by bearings 144 and 146.

The bearings 144 and 146 are positioned in surrounding relation with a shaft portion of the bevel gear 142 by a bearing carrier that is bolted to the nonrotatable annular housing portions 44 and 46. This arrangement maintains the bearings 144 and 146 in position for rotatably supporting the bevel gear 142.

A shaft portion of the bevel gear 142 is connected to a splined portion of a sun gear 148 of the planetary gear assembly 104. With this arrangement, rotation of the input shaft 102 is transmitted by the pinion gear 140 to the bevel gear 142 and therefrom to the sun gear 148. The sun gear 148 includes an axial bore through which the drive shaft 110 extends. The sun gear 148 is rotatable about the drive shaft 110. The sun gear 148 includes an outer tubular portion that meshes with a plurality of planet gears 150, as illustrated in FIGS. 4 and 5.

A planet gear support shaft 152 rotatably supports the planet gears 150 by bearings 158 in meshing relation with the outer tubular gear portion of the sun gear 148. A support shaft 152 is provided for each of the planet gears 150. The planet gears 150 mesh with the sun gear 148 and a ring gear 154. The ring gear 154 is secured to the annular housing portion 44, 46 by bolts 156. Rotation of the sun gear 148 revolves the planetary gears 150 in the fixed ring gear 154. This results in rotation of the planetary gear assembly 104 about the axis of the sun gear 148 which is concentric with the axis of the respective end drum section 50, 52.

Each of the planetary gear support shafts 152 is connected at both end portions to drive shaft 100. The drive shaft 100 is rotatably supported relative to the fixed ring gear 154 by bearings 155. Suitable lubricant seals 160 are positioned between the annular end portion of the drive shaft 100 and the adjacent end of the ring gear 154. With this arrangement, the drive shaft 100 and the planetary gear assembly 104 are supported for rotation on the end drum section relative to the fixed ring gear 154.

The drive shaft 110 is nonrotatably secured by a splined connection to the surrounding drive shaft 100 so that rotation of the drive shaft 100 rotates the drive shaft 110. The drive shaft 100 is connected by bolts to a retainer plate 112. Thus, with this arrangement rotation of the bevel gear 142 by input drive shaft 102 is transmitted through the planetary gear assembly 104 to the drive shaft 100 so that the end drum section 50, 52 is rotated. Rotation of the drive shaft 100 rotates the axial drive shaft 110.

The axial drive shaft 110 extends from the respective end drum section 50, 52 into the intermediate drum section 48. The shaft 132 is axially positioned in the intermediate drum section 48 and is rotatably supported by pairs of bearings 134. An end portion 133 of the shaft 132 includes an external keyway to receive a key (not shown) that is nonrotatably secured into a keyway in the intermediate drum section 48. With this arrangement, rotation of the shaft 132 is transmitted to the intermediate drum section 48.

As illustrated in FIGS. 4 and 5 the lubricant seals 160 are conventional in design and seal the extreme end of the end drum section 50, 52 to retain lubricant within the gearcase housing the bearing assembly 136 and the planetary gear assembly 104. On the opposite side of the end drum section 50, 52 a rotary seal generally designated by the numeral 162 permits water to be introduced externally of the rotating drum 22 into an axial tube 164 within the drum section 50, 52 that extends through the drive shaft 132 for supplying liquid to the spray device 86 for the cutter bits 66 on the drum assembly 22.

DUAL AND SINGLE LIQUID SEAL ARRANGEMENTS

In the dual liquid seal arrangement as illustrated in FIG. 2 each end drum section 50, 52 includes a rotary seal 162 so that liquid is supplied to both end drum sections and distributed to each cutter element 62 (shown in FIG. 13) mounted on the surface of the end drum section. Each end drum section 50 and 52 includes a manifold 166 which is secured by bolts 168 to rotate with the drive shaft 132. The manifold 166 includes a fluid passageway 170 that communicates with the tube 164 for the conveyance of liquid through the tube 164 and out of the manifold 166 through the passageway 170 in the direction indicated by arrow 172.

As shown in greater detail in FIG. 4 liquid is directed through a conduit 174 connecting the manifold 166 to an outlet 176 in the intermediate drum section 48 to the passageway 94 that directs the liquid to the nozzle 86 mounted on the pedestal 70 of the cutting element 62 as shown in FIG. 13. As seen in FIG. 2 the manifold 166 associated with each end drum section 50 and 52 directs water to one half of the intermediate drum section 48. Because the embodiment of the end drum sections 50 and 52 shown in FIG. 2 include rotary seals 162 this arrangement is identified as a dual seal arrangement in supplying liquid to spray nozzles 86.

In the single seal arrangement illustrated in FIG. 3 only end drum section 52 includes a rotary seal 162 so that liquid is introduced into the cutter drum assembly through only one end drum section. From the end drum section 52 the liquid is distributed through the axial tube 164 to the manifold 166 from which liquid is supplied through hose connections, as shown in FIG. 4, to both halves of the intermediate drum section 48 in the direction indicated by arrows 172 and 175. In addition liquid is conveyed centrally through an axial tube or conduit (not shown) in the intermediate drum section 48 in the direction indicated by arrow 176 and therefrom to a manifold 178 connected by bolts 180 to the drive shaft 132 of the end drum section 50.

The liquid in the end drum section 50 is directed by the manifold 178 into the axial tube 164 within the end drum section 50. In view of the fact that the liquid is introduced into the end drum section 50 through the axial tube 164 a rotary seal is not required for conveying liquid externally of the end drum section 50 through rotating and stationary components. For this reason the arrangement shown in FIG. 3 utilizing a rotary seal in only one end drum section for the entire cutter drum assembly 22 is identified as a single seal arrangement.

LIQUID SUPPLY FOR SPRAY NOZZLES

Now referring to FIGS. 5–8 there is illustrated in detail the rotary seal 162 positioned in end drum section 50. It should be understood that the rotary seal 162 for the end drum section 50 corresponds to the same rotary seal 162 used for the opposite end drum section 52 in the dual seal arrangement illustrated in FIG. 2. Liquid is supplied to each end drum section 50 and 52 externally through rotary seals 162. In the single seal arrangement shown in FIG. 3 either one of the end drum sections 50 or 52 is provided with a rotary seal 162. The opposite end drum section receives water through the axial tube 164.

The components for the rotary seal 162 illustrated in FIG. 5 are used for both the dual seal arrangement and the single seal arrangement for supplying liquid through the stationary and rotating drum components into the axial tube 164. The rotary seal 162 arrangement shown in FIG. 5 is used on both end drum sections 50 and 52 in the dual seal arrangement. The following description of the rotary seal 162 is confined to the end drum section 50 illustrated in FIG. 5, and like numerals refer to like parts for the end drum section 52 utilizing the rotary seal 162.

Liquid for the spray nozzles 86 carried by the cutting elements 62 on the cutter drum assembly 22 is supplied from a suitable source on the mining machine 10. For example, water is taken from the cooling circuits for the two cutter drum motors 28 and 30 illustrated in FIG. 1. A conventional filtration system is used to avoid the accumulation of particles within the rotary seal 162 and the conduits, passageways, and hoses that supply the water to the spray nozzles 86. Filtration systems suitable for use with the present invention include conventional Y-strainers and hydrocyclones or any other filtration system operable to prevent dirt from entering the water spray system in the cutter drum assembly 22.

Figure 6:
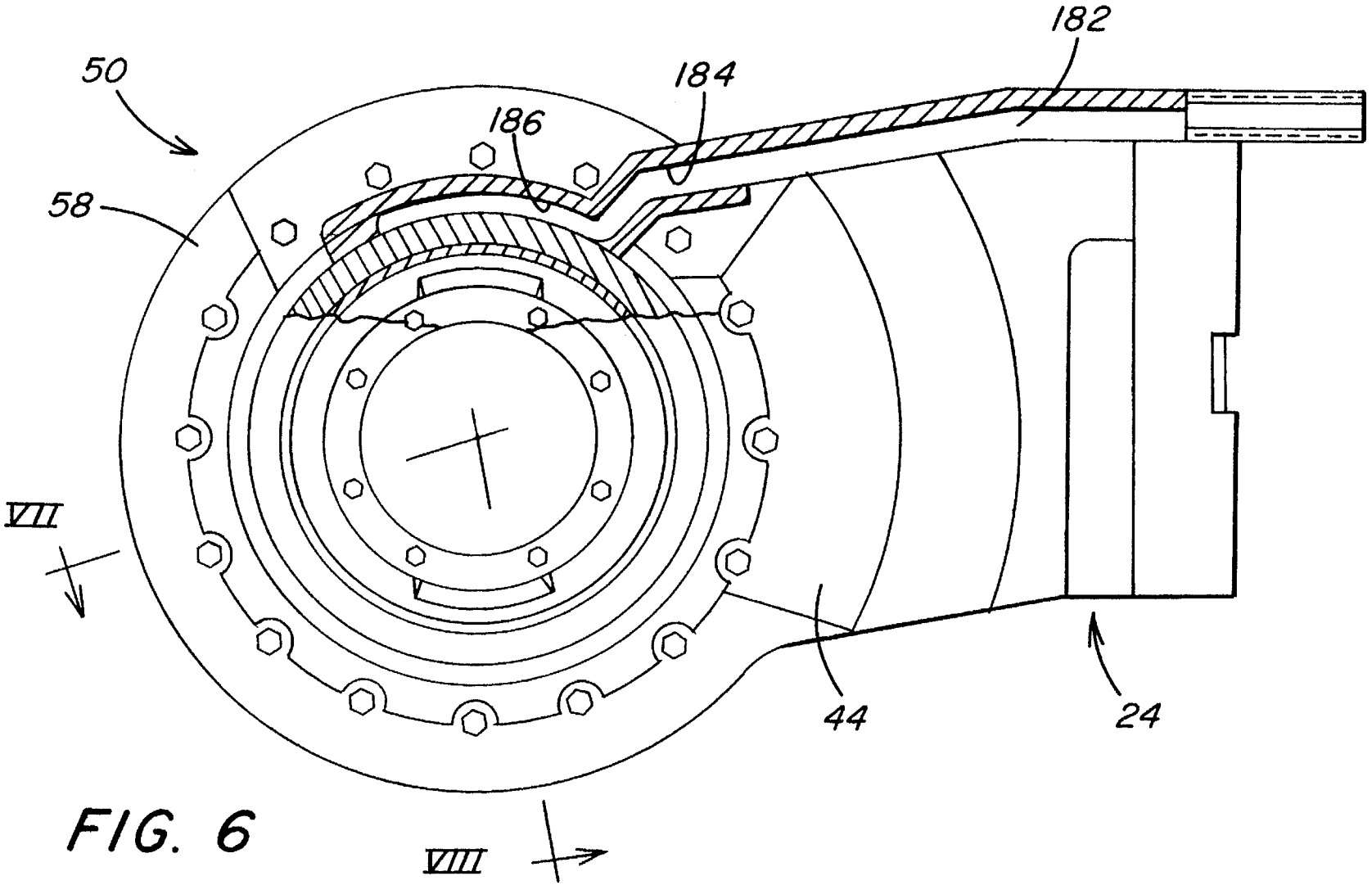
FIG. 6 is a schematic partial sectional view in side elevation of the end drum section shown in FIG. 5.

Water is conveyed from the cooling circuits of the cutter drum motors 28 and 30 through a stationary conduit 182 illustrated in FIG. 6. The conduit 182 extends from the motors 28 and 30 and is supported by the drum housing 24. For the dual seal arrangement the conduit 182 extends on the annular housing portions 44 and 46 between the intermediate end drum section 48 and the respective end drum sections 50 and 52. In the single seal arrangement only one conduit 182 is utilized and is mounted on the annular section 44 or 46 depending on which end drum section 50 or 52 utilizes a rotary seal 162.

As further seen in FIG. 6 the end of the water supply conduit 182 extends on the annular portion 44 between the intermediate drum section 48 and the end drum section 50. The conduit 182 includes an outlet end portion 184 that is connected to the inlet of a port 186, also shown in FIGS. 4 and 5, within the stationary housing 44 positioned in the opening 124 between the intermediate drum section 48 and the end drum section 50. With this arrangement water is conveyed through the conduit 182 on the stationary drum housing 24 into the port 186 of the stationary annular housing portion 44. This arrangement forms the primary water inlet into the cutter drum assembly 22 between the drum sections 48 and 50.

ROTARY SEAL ASSEMBLY

The primary inlet or port 186 communicates with a plurality of radially positioned ports 188, one of which is shown in FIGS. 4 and 5, extending through a bearing carrier 190 for the pair of bearings 134. The bearing carrier 190 is one of the stationary components of the assembly that forms the rotary seal 162. The stationary components of the rotary seal 162 as seen in FIGS. 4 and 5 include O-rings 192 that seal the faces between the adjacent surfaces of the housing portion 44 and the bearing carrier 190. Positioned inboard of the O-rings 192 is an O-ring 194 that is also positioned between the housing portion 44 and the bearing carrier 190 to seal the cavity where the pair of bearings 134 are positioned. The O-ring 194 keeps any fluid leakage from O-ring 192 from coming in contact with the bearings 134 and also keeps the lubricant within the gearcase surrounding the bearings 134.

As illustrated in FIG. 5 the stationary annular housing portion 44 is connected by bolts 130 to the stationary bearing carrier 190 which, in turn, is connected to the stationary components of the rotary seal assembly 162 by bolts 198. Two embodiments of a rotary seal assembly 162 are shown in FIG. 4.

One embodiment of the rotary seal assembly 162 in FIG. 4 is characterized as a mechanical face seal assembly which is also illustrated in greater detail in FIGS. 5, and 7–10. A second embodiment of the rotary seal assembly 162 is characterized as a rotary lip seal and is shown in detail in FIGS. 11 and 12. The rotary lip seal includes a stationary component generally designated by the numeral 200 and is also connected as above described by bolts 198 to the bearing carrier 190.

For purposes of illustration and comparison, FIG. 4 illustrates both the mechanical face seal and the rotary lip seal of the rotary seal assembly 162. The mechanical face seal is generally designated by the numeral 202 in FIG. 4 and is illustrated above the center line of the end drum section. The rotary lip seal is generally designated by the numeral 204 in FIG. 4 and is illustrated below the center line of the end drum section.

It should be understood that either one of the embodiments of the seals 202 and 204 can be used as the rotary seal assembly 162. For example, in FIG. 2 the end drum section 50 includes the mechanical face seal 202 as the rotary seal assembly 162 and the end drum section 52 includes the rotary lip seal 204 as the rotary seal assembly 162. In FIG. 3 for the single seal arrangement the end drum section 52 includes the rotary lip seal 204, and the end drum section 50 does not include a rotary seal assembly.

In accordance with the present invention a conventional continuous mining machine that does not utilize a liquid spray can be converted in the field to include spray nozzles with the cutting elements. The conversion is accomplished by installing on the cutter drum sections the cutting elements 62 illustrated in FIG. 13 and a rotary seal assembly 162 bolted to the bearing carrier 190, as above described.

ROTARY LIP SEAL KIT

Figure 12:
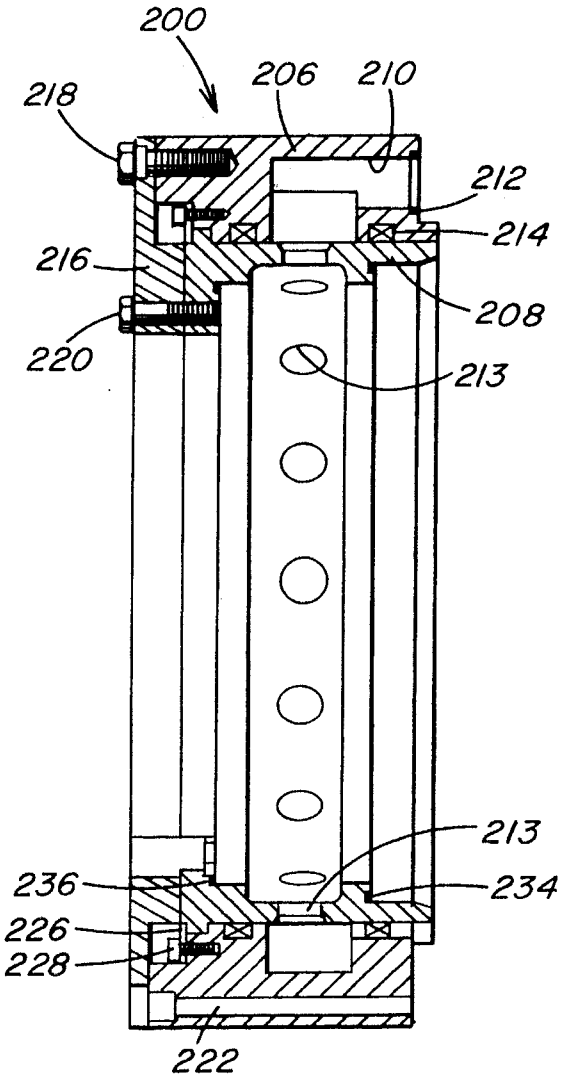
FIG. 12 is a sectional view of the rotary water seal taken along line XII—XII of FIG. 11.
Figure 11:
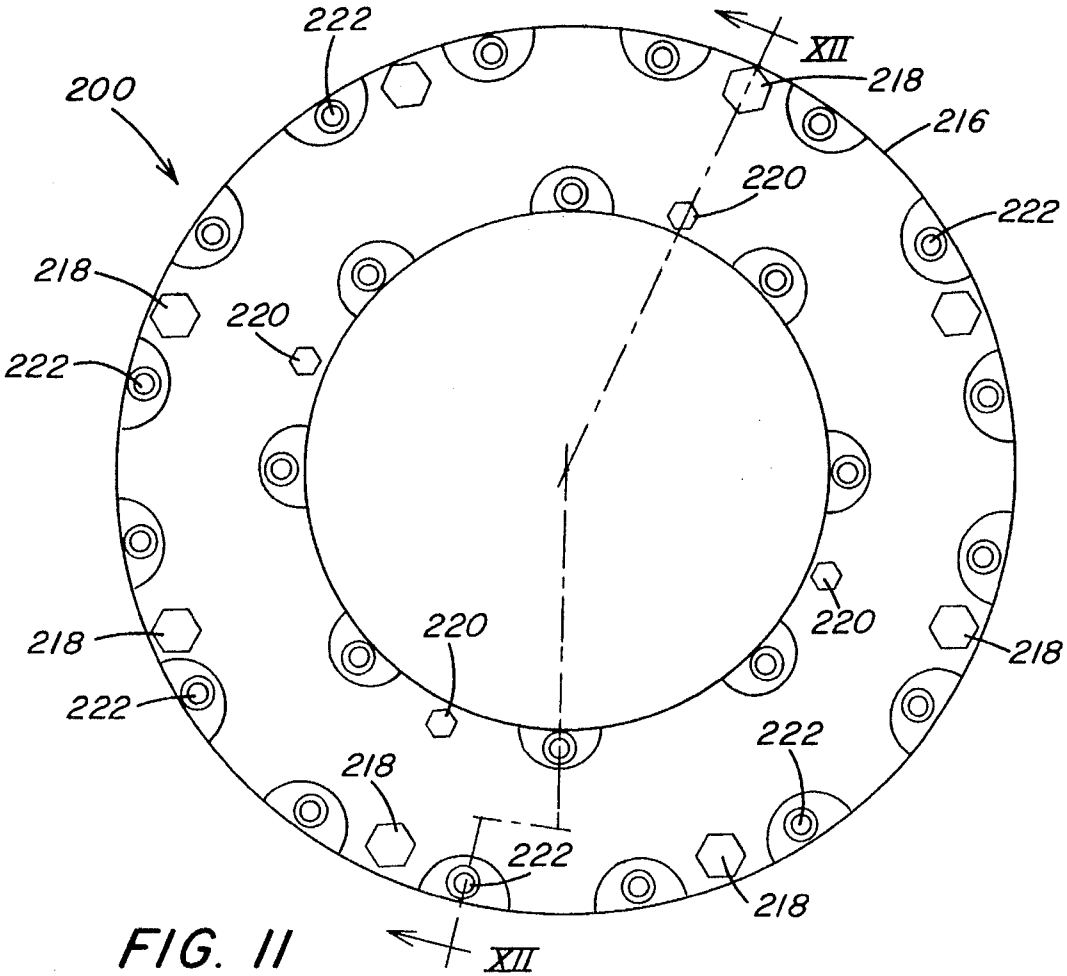
FIG. 11 is an enlarged view in side elevation of a second embodiment of the rotary water seal for the cutter drum assembly shown in FIG. 4.

As illustrated in FIGS. 11 and 12 the conversion kit for the rotary lip seal embodiment includes a seal component 200 in which the parts are maintained in an assembled relation to facilitate their installation on the cutter drum section. The assembled seal component 200 includes an outer stationary seal ring 206 and an inner rotatable seal ring 208. The outer seal ring 206 includes an inlet port 210 which when assembled on the drum section is sealed by an O-ring 212 in communication with the port 188 through the bearing carrier 190 as shown in FIG. 4. The port 210 extends radially on the inside surface of the outer seal ring 206 and communicates with fluid openings 213 in the inner seal ring 208. A pair of spring energized seals 214 seal the inner face between the outer and inner seal rings 206 and 208.

Prior to mounting the seal component 200 of the rotary lip seal 204 on the bearing carrier 190, the seal rings 206 and 208 remain connected to one another by a assembly ring 216. The assembly ring 216 is connected by bolts 218 to the outer seal ring 206 and by bolts 220 to the inner seal ring 208. With this arrangement the inner and outer seal rings 206 and 208 remain connected to facilitate their mounting on the bearing carrier 190. Once the assembled rings 206 and 208 are positioned on the bearing carrier 190, the bolts 218 and 220 are removed to release and remove the assembly ring 216 from connection to the seal rings 206 and 208.

As illustrated in FIGS. 11 and 12 the outer seal ring 206 includes a plurality of bolt holes 222 on the periphery thereof for receiving bolts 198 as shown in FIGS. 2 and 3 for connecting the outer seal ring 206 to the bearing carrier 190. In addition as shown in FIG. 12 the inner and outer seal rings 206 and 208 are maintained in a preselected concentric relationship by a retainer ring 226 abutting in overlying relation the surfaces of the seal rings 206 and 208 and connected by bolts 228 securing the retainer ring 226 to the outer seal ring 206. This arrangement keeps the seal rings 206 and 208 assembled when the component 200 is removed from connection to the bearing carrier 190 and the assembly ring 216 is not reinstalled. Also, once the inner and outer seal rings 206 and 208 are connected to the bearing carrier 190 and the shaft 132 respectively, the assembly ring 216 is removed from connection to the inner and outer seal rings.

As shown in the lower portion of FIG. 4, when positioned in surrounding relation with the bearing carrier 190 the inner seal ring 208 of the rotary lip seal 204 is positioned in surrounding relation with an annular groove 230 formed on the outer surface of the drive shaft 132. The annular groove 230 communicates with four ports 232 that extend through the shaft 132. The ports 232 are positioned in quadrants and only one of the ports 232 is shown in FIGS. 2–5.

Water from the ports 186 and 188 in the annular housing 44 and bearing carrier 190 enters the rotary lip seal 204 through the port 210 and passes therefrom through the openings 213 (FIG. 12) into the ports 232 in the drive shaft 132. The drive shaft 132 is rotatable with the inner seal ring 208. A pair of O-rings 234 and 236, shown in FIG. 12, seal the interface between the inner seal ring 208 and the rotating shaft 132. Thus water flows through the stationary seal ring 206 and rotatable seal ring 208 into the ports 232 and therefrom to the manifold 166 at the end of the drum section 50 opposite the intermediate drum section 48.

MECHANICAL FACE SEAL KIT

Now referring to FIGS. 5 and 7–10 there is illustrated the details of a seal conversion kit that includes a mechanical face seal 202. This embodiment is also illustrated in FIG. 4 above the center line of the end drum section 50. The mechanical face seal 202 is also connected by bolts 198 to the bearing carrier 190 as shown in FIG. 5. This arrangement facilitates the use of either the mechanical face seal 202 or the rotary lip seal 204 as the rotary seal assembly 162 for the respective end drum section.

Referring to FIGS. 5 and 7–10 there is illustrated in greater detail the structure of the mechanical face seal 202 which includes stationary outer seal housings 238 and 240 positioned back-to-back with the bearing carrier 190. Each housing 238 and 240 includes ports 242 and 244 (FIG. 8) that communicate with the aligned ports 246 and 248 in the bearing carrier 190 that drains through an outlet 250 in the annular housing portion 44 to atmosphere. With this arrangement water that leaks from mechanical face seal 202 is diverted out of the cutter drum assembly 22 through the outlet 250.

Figure 8:
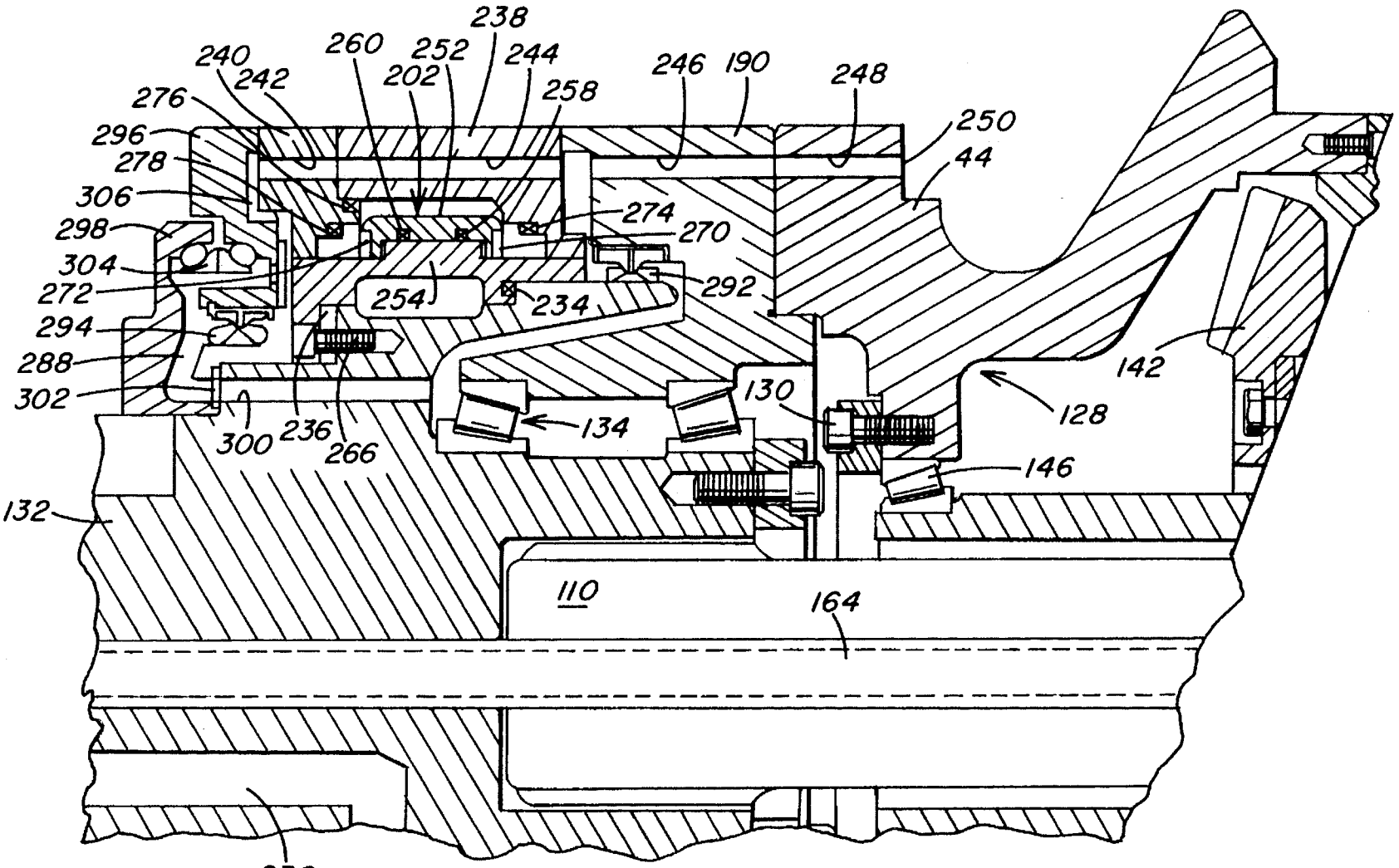
FIG. 8 is a fragmentary sectional view taken along line VIII—VIII of FIG. 6, illustrating the passageways for diverting water leakage at the embodiment of the rotary seal shown in FIG. 7 out of the end drum.
Figure 9:
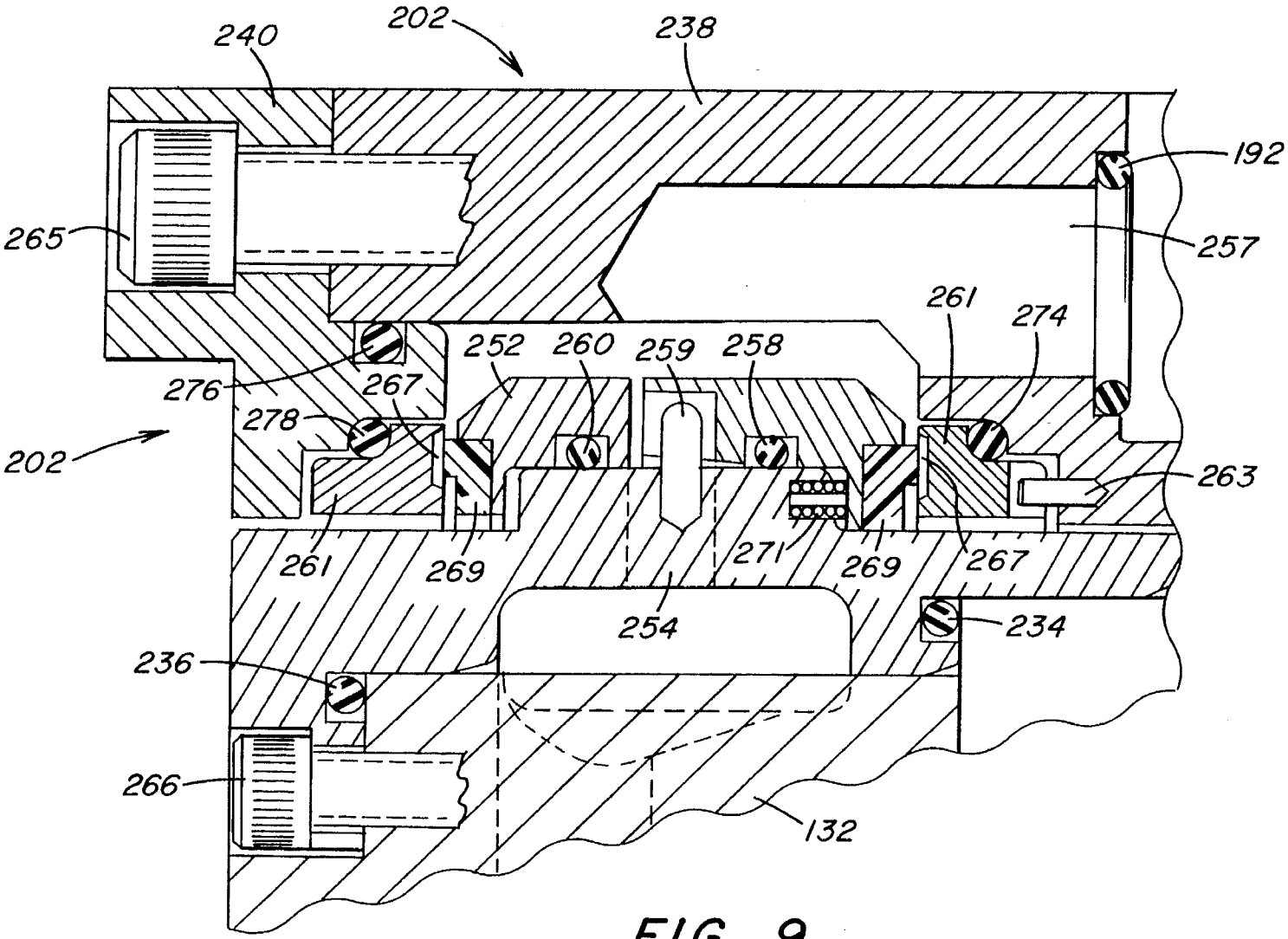
FIG. 9 is an enlarged fragmentary sectional view of the embodiment of the rotary seal shown in FIGS. 7 and 8, illustrating the stationary and rotatable components of the seal.
Figure 10:
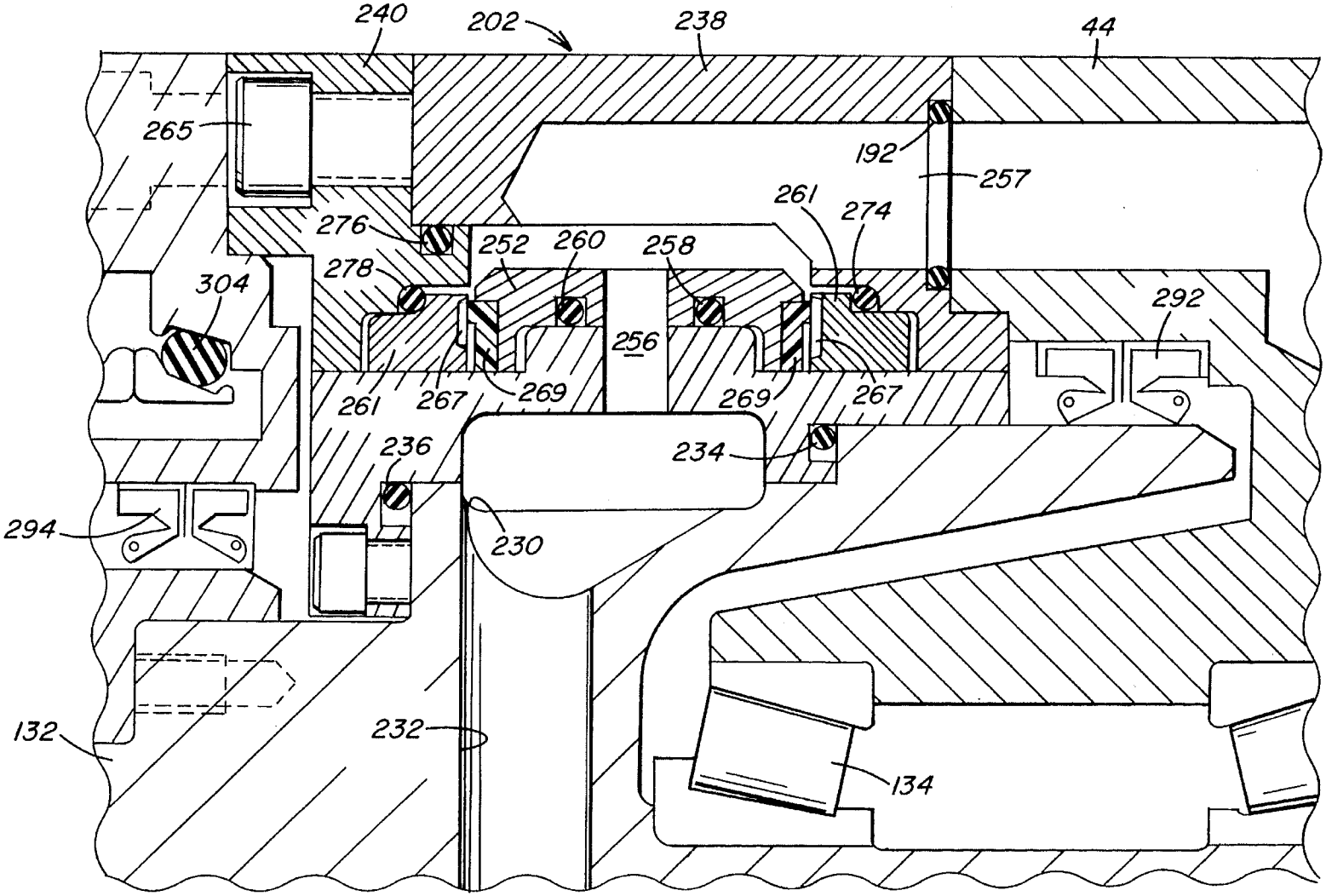
FIG. 10 is a view similar to FIG. 9, illustrating the liquid passageway between the stationary and rotatable components.

As seen in FIG. 8 and in greater detail in FIGS. 9 and 10 concentrically positioned within the stationary seal housings 238 and 240 are a pair of rotatable face seal carrier rings 252 and 254. The carrier rings 252 and 254 are concentrically positioned in surrounding relation with the drive shaft 132 and rotate with the shaft 132. The carrier rings 252 and 254 include ports 256, shown in FIGS. 4 and 10, that open into the annular groove 230 on the surface of the drive shaft 132. Water entering port 186 passes through port 188 into passageway 257 in seal housing 238 and through the ports 256 and the groove 230 into the ports 232 of the drive shaft 132.

The flow of water into the end drum section 50 through the annular portion 44, bearing carrier 190, and the mechanical face seal 202 to the drive shaft 132 is prevented from leaking into the gearcase and contaminating the bearings 134 by a plurality of O-rings as seen in detail in FIGS. 9 and 10. As will be explained later in greater detail, the plurality of O-rings serve as water seals between the stationary components (seal housings 238 and 240) and the rotatable components (carrier rings 252 and 254) of the mechanical face seal 202.

The pair of static O-rings 234 and 236 (FIGS. 9 and 10) seal the interface between the inner carrier 254 and the outer surface of the drive shaft 132 around the ports 232 in the drive shaft. The O-ring pairs 234 and 236 are common to both the mechanical face seal 202 and the rotary lip seal 204 of the rotary seal assembly 162 because they seal around the ports 232 that extend through the rotatable shaft 132.

Referring to FIGS. 9 and 10, the carrier rings 252 and 254 for the mechanical face seal 202 are connected by a pin 259. The inner carrier ring 254 is connected by a plurality of bolts 266 to the drive shaft 132 so that the carrier rings 252 and 254 rotate with the shaft 132. The carrier rings 252 and 254 are surrounded by a reaction ring 261 which is connected by a dowel pin 263 to the stationary seal housing 240. As seen in FIG. 9, seal housing 240 is connected by bolts 265 to the seal housing 238. Therefore, the carrier rings 252 and 254 rotate relative to the stationary reaction ring 261.

As seen in FIG. 10 water enters the passageway 257 in the seal housing 238 and is directed through the seal housing 240 into the ports 256 in the carrier rings 252 and 254. From the ports 256, the water passes through the annular groove into the ports 232 of the rotatable shaft 132. The water flow path through the stationary components (238 and 240) and the rotatable components (252 and 254) of the mechanical face seal 202 into the shaft 132 is sealed by a plurality of surrounding O-rings.

O-rings 192 seal the stationary interface between the bearing carrier 190 and the mechanical face seal 202. The O-rings 234 and 236 seal the rotating interface between the shaft 132 and the mechanical face seal 202. Within the mechanical face seal O-rings 258 and 260 seal the interface between the outer and inner seal carriers 252 and 254 around the ports 256. O-ring 276 provides a seal between the outer interface between seal housings 238 and 240.

The inner and outer seal housings 238 and 240 retain the reaction ring 261 in surrounding relation with the carrier ring 252 on the carrier ring 254. O-rings 274 and 278 provide a water seal around the reaction ring 261 at the interface with the seal housings 238 and 240. The O-rings 274 and 278 also apply uniform inward radial pressure upon the reaction ring 261.

As further seen in FIGS. 9 and 10 for the mechanical face seal 202, rotatable sealing faces are provided between the stationary component (reaction ring 261) and the rotatable component (carrier ring 252). This is accomplished by bonding onto the inner surface of the stationary reaction ring 261, a ring of ceramic material 267, such as aluminum oxide. The rotatable carrier ring 252 includes a carbon ring 269 which is secured by an epoxy bond to the periphery of the carrier ring 252 opposite the ceramic ring 267. The ceramic ring 267 and the carbon ring 269 have opposite mating faces positioned in abutting and sealing relation.

A spring mechanism 271 is retained on the carrier ring 254 and acts against the carrier ring 252 to exert an initial load on the carbon ring 269. This maintains the initial sealing relation between the carbon ring 269 and the ceramic ring 267. Once water begins to flow through the ports 256, as seen in FIG. 10, hydraulic pressure is generated on the carrier rings 252 and 254 to increase the sealing pressure between the ceramic ring 267 and the carbon ring 269. With this arrangement, water passes through the mechanical face seal 202 into the rotatable shaft 132 and is prevented from coming into contact with the bearings in the gearcase.

Figure 7:
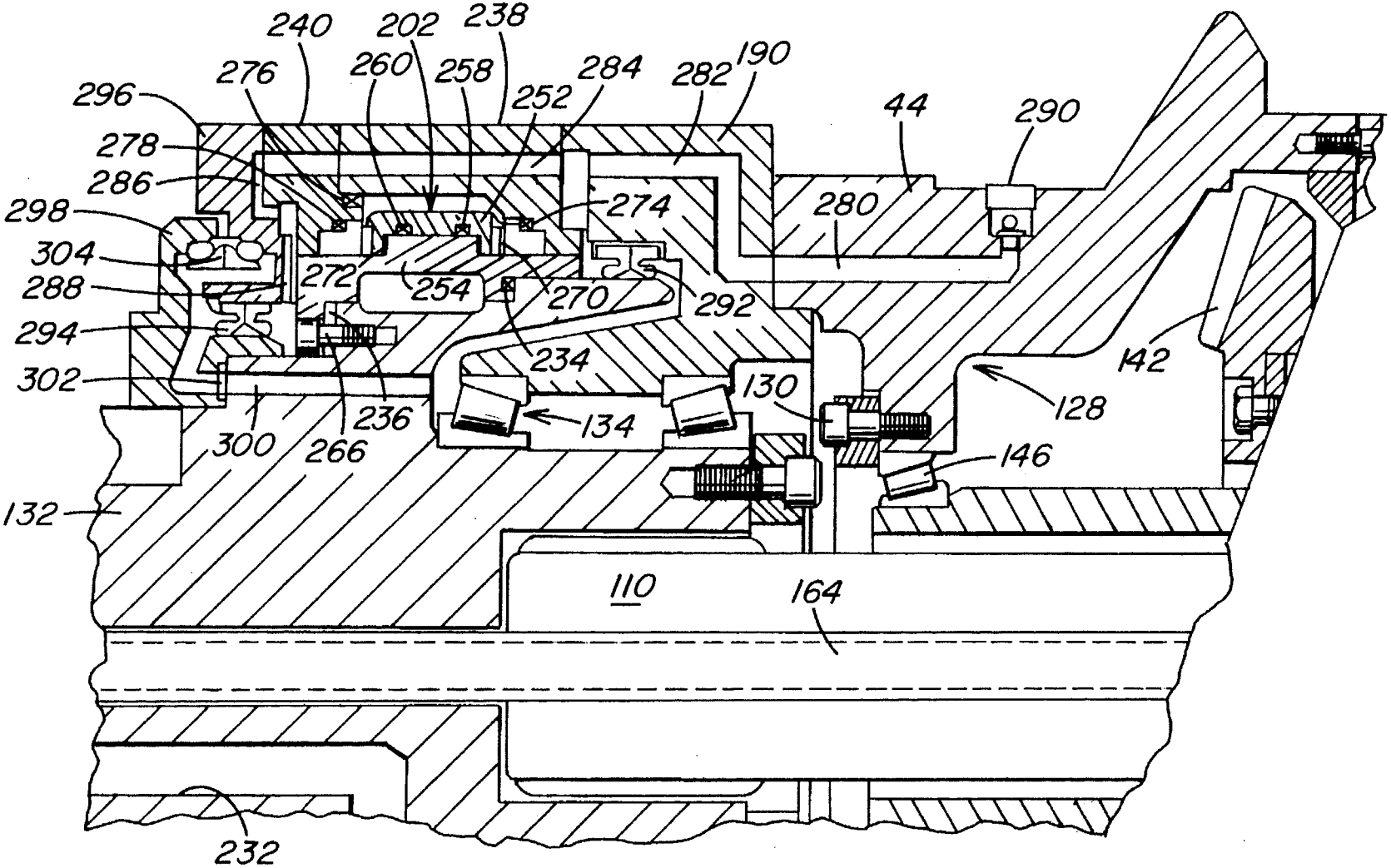
FIG. 7 is a fragmentary sectional view of the end drum section taken along line VII—VII of FIG. 6, illustrating the passageways for introducing lubricant into the gearcase around one embodiment of the rotary seal shown in FIG. 5.

Referring to FIG. 7 there is illustrated the arrangement for supplying, as needed, lubricant to the rotary seal assembly 162 including either the mechanical face seal assembly 202 or the rotary seal assembly 204. A series of lubrication ports 280, 282, 284, 286, and 288 extend from a grease fitting 290 in the annular housing 44 to the cavities where a pair of back-to-back lip seals 292 and 294 are positioned. The lip seals 292 and 294 surround the rotary seal assembly 162 to prevent water leakage through the components of the rotary seal assembly into contact with the bearings 134.

One half of lip seals 292 and 294 is exposed to the lubricant in the bearing assembly 128 and retains the lubricant in the gearcase. The other half of each lip seal 292 and 294 is exposed to the water flow entering the annular housing 44 of the respective cutter drum section. Thus, the lip seals 292 and 294 keep the lubricant in the gearcase and keep the water out of the gearcase. To provide an effective seal for both of these purposes the side of the lip seals 292 and 294 exposed to the water flow is lubricated from the ports open to the fitting 290.

The water side of the lip seal 292 receives lubricant from the vertical passage extending downwardly from between the ports 282 and 284 as shown in FIG. 7. Similarly, on the opposite side, the water side of the lip seal 294 receives lubricant from the port 288 which is also connected to the fitting 290.

With the above described arrangement, the lip seals 292 and 294 serve as redundant seals to back-up the O-rings which prevent leakage of water through the rotary seal assembly 162 into the gearcase. To maintain the sealing efficiency of the lip seals 292 and 294, the side of the lip seals exposed to water is also lubricated externally of the gearcase through the series of ports communicating with the lubricant fitting 290. This is particularly beneficial during the periods of time when the cutter drum assembly 22 is run "dry" even though sufficient water is always present within the assembly 22 to prevent the lip seals 292 and 294 from drying out and losing their sealing capabilities.

REDUNDANT LIQUID SEAL ARRANGEMENT

As seen in FIGS. 5, 7 and 8 the pair of lubrication lip seals 294 are retained in surrounding relation with the rotary seal assembly 162 by an inboard seal carrier 296 and an outboard seal carrier 298. The outboard seal carrier 298 includes ports that are sealed to maintain the bearings 134 lubricated in the gearcase. The outboard seal carrier 298 includes four ports 288 (FIGS. 7 and 8) that extend from the lip seal 294 to four holes 300 that open into the cavity containing the bearings 134.

The interface between the ports 288 aligned with the holes 300 is sealed by O-rings 302. The O-rings 302 are positioned on the lubricant side of the lip seal 294 within the lubricant passage from the bearings 134. Cat seal 304 is positioned on the other side of the lip seal 294 in the lubricant passageway. The cat seal 304 is retained by the inboard and outboard seal carriers 296 and 298 in surrounding relation with the rotary seal assembly 162. With this arrangement the cat seal 304 is positioned in the gearcase outboard of the rotary seal assembly 162 and the above described arrangement of static O-rings that prevent leakage of water from the rotary seal assembly 162 into the gearcase.

The lip seal 294 and the cat seal 304 are thus positioned outboard of the rotary seal assembly 162. Lubricant from the bearing assembly 128 flows through the holes 300 and ports 288 into contact with one side of lip seal 294 and the cat seal 304. With this arrangement the static liquid O-ring seals that seal the rotary seal assembly 162 are located inside the gearcase of the cutter drum assembly 22. The water side of the lip seals 292 and 294 and cat seal 304 face the passageways that are vented to the atmospheric drain 250 (FIG. 8) for diverting water that leaks from the rotary seal assembly 162 away from the bearings 134. The liquid leakage is directed through the aligned ports to the atmospheric outlet 250 to protect the bearings 134 from liquid contamination.

The lips seals 292 and 294 prevent water leakage from passing through the rotary seal assembly 162 into the bearing assembly 128. One side of each of the lip seals 292 and 294 retains lubricant within the bearing assembly 128. The other side of each lip seal is positioned opposite the O-rings 234 and 236 (FIGS. 7 and 8) of the rotary seal assembly 162 and the O-rings 192, 194, 212, 274, 276, and 278 (FIGS. 4 and 5) within the stationary annular housing 44. Any liquid leakage through these O-rings is stopped by the lip seals 292 and 294 and diverted out of the housing 44 to the atmospheric drain 250. Thus, the pair of lip seals 292 and 294 operate as lubricant seals for bearing assembly 128 and redundant water seals for the rotary seal assembly 162 to direct liquid leakage outwardly through the annular housing 44 to atmosphere.

As seen in FIG. 8 the seal carrier 296 includes a cavity 306 that communicates on one side with the atmospheric drain formed by the communicating ports 242, 244, 246, and 248 and on the other side to the cavity surrounding the inner carrier ring 254 and rotatable shaft 132. This connected arrangement of cavities and ports serves to drain any water leakage from the rotary seal assembly 162 outwardly out of the cutter drum assembly 22. In addition, as illustrated in FIGS. 4 and 5 any water leakage through the static O-rings 212, 274, 276 and 278 that seal the passageways for conveying liquid through the rotary seal assembly 162 is vented to atmosphere. At any point in the gearcase where water leakage may occur it is diverted away from the bearing assembly 128 and out of the gearcase.

LUBRICATION OF ROTARY SEAL ASSEMBLY

Lubricating the lip seals 292 and 294 serves to maintain the life of the lip seals to seal against water leakage into the bearing assembly 128. Lubricating the liquid seals protects them against the deleterious effects encountered particularly for the periods of time when the cutter drum assembly 22 is "run dry" and no water is supplied to the cutting elements 62.

With the rotary seal assembly 162 of the present invention the mining machine 10 may be run dry for an extended period of time without damage thereto. Portions of the lip seals 292 and 294 are normally in contact with a continuous stream of liquid and are prevented from drying out. However, in the event the mining machine is "run dry" for an extended period of time consideration must be given to maintaining the lip seals 292 and 294 lubricated.

With the prior art devices when the mining machine runs dry, the liquid side of the lip seals dries out and looses its resiliency to provide an effective liquid seal when the cutter drum assembly 22 is "run wet". However, with the present invention by maintaining the portion of the lip seals 292 and 294 on the liquid side lubricated, they do not loose their resiliency when the mining machine is run dry for an extended period of time. When the cutter drum assembly 22 is restored to wet operation the lip seals are effective to prevent liquid leakage into the gearcase.

It should be understood that with the present invention once water is introduced into the annular housing 44 and through the rotary seal assembly 162, water is captured within the ports 186 and 188 and around the rotary seal assembly 162. This maintains water in contact with the water side of the lip seals 292 and 294. Even during the periods of time when the mining machine 10 is run dry, water remains in contact with the lip seals 292 and 294. They do not dry out.

Water does not drain completely out of the ports 184 and 186 (FIG. 6). This is due to the large diameter of the water seal assembly 162. There are areas around the assembly 162, such as ports 188 and passageways 257 (FIG. 5), that are below the ports 184 and 186 out of the annular housing 44. This serves to maintain a quantity of water in the annular housing 44 when the cuter drum assembly 22 is run dry. Consequently, the lip seals 292 and 294 are prevented from drying out. Water is captured within the cutter drum assembly 22 to maintain the lip seals 292 and 294 resilient and flexible. This captured water also serves to maintain the rotary seal assembly 162 running cool when the mining machine 10 is run dry. The assembly 162 is thus prevented from overheating due to friction.

Lubricant is forced through the series of ports and cavities that vent to the atmospheric port 250 shown in FIG. 8 to maintain the lip seals 292 and 294 lubricated on the side facing the drain cavity. Injecting lubricant through the atmospheric drain outlet 250 also serves to flush the ports and cavities drained to atmosphere with lubricant. In the event leakage should occur through the rotary seal assembly 162 the presence of the lubricant in the ports and cavities vented to atmosphere is flushed out so that lubricant does not block the liquid leakage out of the gearcase.

Both lip seals 292 and 294 communicate with the atmospheric drain, and, both sides of the rotary seal assembly 162 are effectively drained to the atmospheric outlet 250. For example, if liquid should leak past any one of the pairs of O-rings 258, 260 and 234, 236 of the mechanical face seal 202 that seals the rotatable shaft 132, the leakage is stopped by the water side of the lip seals 292 and 294 and is drained from the atmospheric outlet 250. In this capacity the lip seals 292 and 294 operate as redundant liquid seals to prevent leakage into the gearcase from the rotary seal assembly 162.

As seen in FIG. 7 the lubrication port 280 is plugged by the fitting 290; while, the port 248 shown in FIG. 8 is open to atmosphere at port 250. The outlet for the fitting 290 is threaded to receive the fitting but the outlet 250 is not threaded to prevent the outlet 250 from being closed by the insertion of a fitting. The outlet 250 must remain open to atmosphere for liquid leakage and flushing lubricant out of the outlet 250. Also the atmospheric port 250 remains open so that it can be purged of any dirt or debris.

LIQUID TRANSPORT TO CUTTER BIT SPRAY NOZZLES

As seen in FIGS. 2–5 the tube 164 extends axially through the concentrically positioned shafts 110 and 132. The tube 164 extends at one end portion beyond the intermediate drive shaft 110 and includes an end cap 316 welded thereto. O-rings 310 and 312 are positioned on opposite sides of the end cap 308. The O-ring 310 seals the interface between the end cap 308 and the drive shaft 100 which is splined in surrounding relation to the intermediate drive shaft 110.

The O-ring 310 prevents escape of lubricant from the respective end drum section between the rotating shafts 100 and 110. The end cap 308 is non-rotatably connected by bolts 314 to the drive shaft 100. The O-ring 312 is positioned at the interface between the end cap 316 welded to the end of the tube 164 and the end cap 308. The O-ring 312 prevents escape of lubricant from around the tube 164 between the end cap 308 and end cap 316.

At the opposite end of the respective end drum section, the tube 164 extends into the manifold 166 that is secured by bolts 168 to the shaft 132. As above described, the manifold 166 includes the passageway 170 for distribution of liquid from the rotary seal assembly 162 through the ports 232 in the shaft 132.

As seen in FIGS. 4 and 5 the manifold 166 includes a plurality of outlets 318, 320, and 322 that communicate with inlet 324 into passageway 170. The inlet 324 is sealed by O-ring 326. The point where the tube 164 extends from the shaft 132 into the manifold 166 is sealed by a tandem series of O-rings 328 and 330. A pair of O-rings 328 seal the manifold 166 around the tube 164 from water leakage. The tandem pair of O-rings 330 seal the tube 164 to the shaft 132 to prevent lubricant from escaping around the tube 164 and out of the bearing assembly.

The manifold 166 also includes keyways 332 that extends transversely on its face opposite the end of the shaft 132. Any liquid leakage that passes by the tandem pairs of O-rings 328 is directed away from the shaft 132 through the keyways 332 to atmosphere. Four keyways 332 are positioned in quadrants on the surface of the manifold 166 opposite the shaft 132.

With the embodiment of the dual seal arrangement shown in FIG. 2 where rotary water seals 162 are positioned in both end drum sections 50 and 52, water is directed from the manifold 166 through a fitting connecting the conduit 174 to the manifold outlet 318. From the conduit 174 the water is supplied to the spray nozzles 86 on the cutting elements 62 of the intermediate drum section 48. As shown in FIG. 2 water is supplied from both manifolds 166 of the end drum sections 50 and 52 to the intermediate drum section 48.

In the embodiment for the single seal arrangement shown in FIG. 3, only end drum section 52 is provided with a rotary seal assembly 162. Water is directed from manifold 166 to the intermediate drum section 48 through outlets 318 and 320 and through outlet 322 for conveyance through a central tube in the intermediate drum section 48 and therefrom into the central tube 164 in the opposite end drum section 50.

In FIG. 4 only one fitting is shown for the manifold outlet 318. The other outlets 320 and 322 are plugged. In the embodiments where water is directed from all three manifold outlets 318, 320, and 322. Each outlet is provided with a fitting and flexible conduit as shown connected to the outlet 318 in FIG. 4.

In both the single and double seal embodiments shown in FIGS. 2 and 3 liquid is directed, as show in FIG. 4, from the tube 164 extending from the end cap 308 bolted to the outboard end of the respective end drum section. A fitting 334 is threaded onto the end of the tube 164 that extends beyond the end cap 308. The fitting 334 is connected by a flexible conduit 336 to a fitting 338 connected to a port 340 that supplies liquid to passageways 342 and 344. The passageways 342 and 344 communicate with the passageways 94 that supply liquid through the passageways of the bit holders 64 to the spray nozzles 86 of the cutting elements 62.

It should be understood that substantially all of the cutting elements 62 on the cutter drum assembly 22 are equipped with spray nozzles 86. Preferably the spray nozzles 86 are used to direct a spray of liquid at the point where the cutting tips 82 strike the mine face to suppress dust generation and sparking from frictional engagement of the tips with the mine face. The nozzles 86 can also be used to generate a high pressure spray operable to dislodge solid material from the mine face.

According to the provisions patents statues, we have explained the principle, preferred construction, and mode of operation of our invention and have illustrated and described what we now consider to represent its best embodiments. However, it should be understood that within the scope of the appended claims, the invention may be practiced otherwise as specifically illustrated and described.

We claim:

1. A mining machine comprising, a body portion, a boom member extending forwardly from said body portion, a cutter drum assembly rotatably mounted on said boom member, cutting elements secured to said cutter drum assembly and extending therefrom, bearing means for rotatably supporting said cutter drum assembly on said boom member, power means mounted on said body portion for rotating said cutter drum assembly, drive means for transmitting rotation from said power means to said cutter drum assembly, spray devices carried by said cutting elements for directing a liquid spray from said cutting elements during rotation of said cutter drum assembly, conduit means stationarily positioned on said body portion for supplying liquid to said cutter drum assembly, liquid passageways extending through said cutter drum assembly and rotatable therewith for directing liquid from said conduit means to said spray devices, a liquid seal assembly carried by said cutter drum assembly for directing liquid from said stationarily positioned conduit means to said rotatable liquid passageways while preventing leakage of liquid into contact with said bearing means, drainage means extending from said seal assembly through said cutter drum assembly for diverting liquid leakage away from said bearing means and externally out of said cutter drum assembly, lubricant passageways extending through said cutter drum assembly to supply lubricant to said liquid seal assembly, a lubricant seal assembly positioned in said cutter drum assembly in surrounding relation with said liquid seal assembly and in contact with said lubricant passageways for preventing the escape of liquid into said bearing assembly and permitting lubricant to be supplied for lubricating said liquid seal assembly, and said lubricant seal assembly being positioned between said bearing assembly and said liquid seal assembly and communicating with said drainage means so that liquid leakage from said liquid seal assembly toward said bearing assembly is stopped by said lubricant seal assembly and diverted to said drainage means.

2. A mining machine as set forth in claim 1 which includes, said lubricant seal assembly communicating with said lubricant passageways, and common means for supplying lubricant through said lubricant passageways to said liquid seal assembly and said lubricant seal assembly.

3. A mining machine as set forth in claim 1 in which, said lubricant seal assembly includes a first portion exposed to the liquid directed to said liquid seal assembly and to the lubricant supplied to said liquid seal assembly, and a second portion exposed to lubricant retained within said bearing means.

4. A mining machine as set forth in claim 3 in which, said lubricant seal assembly first portion serves as a redundant seal to back-up said liquid seal assembly to prevent liquid from flowing into contact with said bearing means.

5. A mining machine as set forth in claim 1 in which, said lubricant seal assembly is positioned in surrounding relation with said liquid seal assembly to maintain lubricant in said lubricant passageways supplied to said liquid seal assembly while preventing escape of liquid from said liquid seal assembly into said bearing assembly.

6. A mining machine as set forth in claim 5 in which, said lubricant seal assembly includes a seal portion exposed to liquid flowing through said liquid seal assembly, and said seal portion being supplied with lubricant from said lubricant passageways.

7. A mining machine as set forth in claim 1 which includes, means for maintaining said liquid seal assembly lubricated when said cutter drum assembly is rotated for the periods of operation when flow of liquid to said spray device is interrupted.

8. A mining machine as set forth in claim 1 in which, said lubricant seal assembly includes at least one lip seal, said lip seal including a first seal portion exposed to the liquid directed through said liquid seal assembly and a second seal portion exposed to said bearing assembly, and said first and second seal portions positioned in back-to-back relation with said first seal portion maintaining the liquid within said liquid seal assembly and said second seal portion maintaining lubricant in said bearing assembly.

9. A mining machine as set forth in claim 8 in which, said first seal portion exposed to liquid from said liquid seal assembly is lubricated by lubricant supplied from said lubricant passageways and prevents liquid supplied to said spray devices from entering said bearing assembly.

10. A mining machine as set forth in claim 8 which includes, seal means carried on said cutter drum assembly in surrounding relation with said lip seal, and ports in said cutter drum assembly connecting said seal means with said lip seal second seal portion for supplying and maintaining lubricant in said bearing assembly.

11. A mining machine as set forth in claim 1 which includes, said lubricant seal assembly communicating with said drainage means for diverting liquid that escapes from said liquid seal assembly out of said cutter drum assembly to atmosphere, and said lubricant seal assembly operable in one mode as a lubricant seal for said bearing assembly and a redundant liquid seal for said liquid seal assembly to direct liquid leakage outwardly through said cutter drum assembly to atmosphere.

12. A mining machine as set forth in claim 1 which includes, means for maintaining liquid in contact with said liquid seal assembly and said lubricant seal assembly when operation of said spray device is interrupted to prevent heat build-up in said liquid seal assembly and said lubricant seal assembly from drying out.

13. A mining machine as set forth in claim 1 in which, said cutter drum assembly includes an intermediate drum section and a pair of end drum sections, and means for supplying liquid in a first mode to one end drum section for internal distribution to both said intermediate drum section and said other end drum section and in a second mode simultaneously to both end drum sections and therefrom to opposite ends of said intermediate drum section.

14. A method for spraying a mine face with liquid during a mining operation comprising the steps of, rotatably supporting a cutter drum assembly mounted on a boom member extending forwardly of a machine body portion, securing cutting elements to the surface of the cutter drum assembly, rotating the cutter drum assembly to dislodge material from the mine face by the cutting elements, discharging a liquid spray from the cutting elements upon the mine face as the cutter drum assembly rotates, supplying liquid from the machine body portion to the cutter drum assembly, directing flow of liquid through liquid passageways from a stationary portion to a rotatable portion of the cutter drum assembly and therefrom to the cutting elements on the cutter drum assembly, positioning seals of a liquid seal assembly between the stationary portion and the rotatable portion to prevent liquid from coming into contact with bearings for rotatably supporting the cutter drum assembly, positioning a lubricant seal assembly in surrounding relation with the liquid seal assembly between the liquid seal assembly and the bearings, supplying lubricant for the lubricant seal assembly and the liquid seal assembly, venting the lubricant seal assembly and the liquid seal assembly through cavities in the cutter drum assembly to atmosphere, diverting liquid leakage from the liquid seal assembly away from the bearings and through the cavities to atmosphere, and backing up the liquid seal assembly by the lubricant seal assembly to prevent liquid leakage to the bearings and divert liquid leakage through the cavities and externally of the cutter drum assembly.

15. A method as set forth in claim 14 which includes, supplying lubricant to the lubricant seal assembly and the liquid seal assembly through common passageways in the cutter drum assembly.

16. A method as set forth in claim 14 which includes, replacing the liquid seal assembly on the cutter drum assembly while maintaining the bearings sealed against the loss of lubricant within the cutter drum assembly.

17. A method as set forth in claim 14 which includes, maintaining liquid within the liquid seal assembly during periods of operation of the cutter drum assembly when spraying operations are interrupted to prevent the liquid seal assembly from overheating due to the affects of friction.

18. A seal assembly for a cutter drum of a mining machine comprising, a plurality of cutting elements secured to the periphery of a cutter drum, a gearcase positioned in the cutter drum, bearing means for rotatably supporting said gearcase in the cutter drum, means for supplying lubricant to said gearcase for lubricating said bearing means, lubricant seal means positioned in said gearcase for maintaining lubricant in contact with said bearing means and preventing containments from coming in contact therewith, a plurality of spray devices associated with said cutting elements for generating liquid spray therefrom, means for supplying liquid flow through said gearcase to said spray devices, liquid seal means positioned in said gearcase for directing liquid through said gearcase to said spray devices and preventing liquid from coming into contact with said bearing means, said liquid seal means being vented to atmosphere so that liquid leakage from said liquid seal means is directed away from said bearing means externally of said gearcase, said lubricant seal means surrounding said liquid seal means in said gearcase to act as a redundant seal to prevent liquid leakage from said liquid seal means contaminating said bearing means, and said liquid seal means and said lubricant seal means communicating with a common source of lubricant thereto and connected through passageways for venting liquid leakage to atmosphere externally of said gearcase.

19. A seal assembly as set forth in claim 18 which includes, means for retaining liquid within said liquid seal means and in contact with said lubricant seal means for cooling said liquid and lubricant seal means during operation of the cutter drum when flow of liquid to said spray devices is interrupted.

20. A seal assembly as set forth in claim 18 which includes, means for supplying lubricant to passages in said gearcase for venting liquid leakage to atmosphere.

* * * * *

UNITED STATES PATENT AND TRADEMARK OFFICE

CERTIFICATE OF CORRECTION

PATENT NO. : 5,507,565
DATED : April 16, 1996
INVENTOR(S) : Maurice K. LeBegue, Ronald W. Keen It is certified that error appears in the above-indentified patent and that said Letters Patent is hereby corrected as shown below:

column 1, line 41, delete "on";

column 3, line 63, delete "loose" and insert --lose--;

column 11, line 46, delete the numeral "156";

column 12, line 40, delete the numeral "176";

column 15, line 11, delete "a" and insert --an--;

column 19, line 19, delete "loose" and insert --lose--;and

In the claims:

claim 18, column 24, line 44, delete "containments" and insert --contaminants--.

Signed and Sealed this

Fifteenth Day of October, 1996

*Attest:*

*Attesting Officer*

BRUCE LEHMAN

*Commissioner of Patents and Trademarks*